US011964683B2

(12) United States Patent
Handa et al.

(10) Patent No.: US 11,964,683 B2
(45) Date of Patent: Apr. 23, 2024

(54) TRAIN CONTROL DEVICE, METHOD, AND PROGRAM

(71) Applicant: MITSUBISHI HEAVY INDUSTRIES, LTD., Tokyo (JP)

(72) Inventors: Takanobu Handa, Tokyo (JP); Noritaka Yanai, Tokyo (JP); Atsuyoshi Saimen, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 353 days.

(21) Appl. No.: 17/621,546

(22) PCT Filed: Feb. 19, 2020

(86) PCT No.: PCT/JP2020/006587
§ 371 (c)(1),
(2) Date: Dec. 21, 2021

(87) PCT Pub. No.: WO2020/261637
PCT Pub. Date: Dec. 30, 2020

(65) Prior Publication Data

US 2022/0355842 A1 Nov. 10, 2022

(30) Foreign Application Priority Data

Jun. 26, 2019 (JP) ..... 2019-118980

(51) Int. Cl.
*B61L 27/40* (2022.01)
*B61L 27/20* (2022.01)

(52) U.S. Cl.
CPC ..... *B61L 27/40* (2022.01); *B61L 27/20* (2022.01); *B61L 2027/204* (2022.01); *B61L 2201/00* (2013.01)

(58) Field of Classification Search
CPC .... B61L 27/40; B61L 27/20; B61L 2027/204; B61L 2201/00; B61L 15/0027; B61L 19/06; B61L 21/04
See application file for complete search history.

(56) References Cited

U.S. PATENT DOCUMENTS 8,370,006 B2 * 2/2013 Kumar ..... B61L 25/026 701/19
8,751,073 B2 * 6/2014 Kumar ..... B61L 25/025 701/19

(Continued)

FOREIGN PATENT DOCUMENTS

GB 2544221 5/2017
JP 2011-20578 2/2011

(Continued)

OTHER PUBLICATIONS

International Search Report dated May 19, 2020 in International Application No. PCT/JP2020/006587.

(Continued)

*Primary Examiner* — Bhavesh V Amin
(74) *Attorney, Agent, or Firm* — Wenderoth, Lind & Ponack, L.L.P.

(57) ABSTRACT

A train control device including a control logic generation unit that uses an environmental model defined by the number of a plurality of closed sections constituting a track included in a predetermined control target region, a connection configuration of the closed sections, and the number of trains present on the track, a state of the environmental model being changed discretely according to a combination of a position of one control target train that is the train to be controlled, positions of zero or more other trains, and the presence or absence of reservation for each of the closed sections, and generates a control logic that is a logic for transitioning the state of the environmental model depending (Continued)

on the state of the environmental model so as to satisfy a predetermined condition, and a regeneration instruction unit that instructs the control logic generation unit to regenerate the control logic.

11 Claims, 18 Drawing Sheets

(56) References Cited

U.S. PATENT DOCUMENTS

| | | | | |
|---|---|---|---|---|
| 2007/0219681 | A1* | 9/2007 | Kumar | B61L 25/025 701/19 |
| 2013/0131898 | A1* | 5/2013 | Kumar | B61L 25/021 701/20 |
| 2015/0344050 | A1 | 12/2015 | Yanai et al. | |
| 2016/0046306 | A1 | 2/2016 | Miyajima | |
| 2017/0217461 | A1 | 8/2017 | Echizen et al. | |
| 2018/0346005 | A1 | 12/2018 | Yanai et al. | |
| 2022/0355842 | A1* | 11/2022 | Handa | B61L 15/0027 |

FOREIGN PATENT DOCUMENTS

| | | |
|---|---|---|
| JP | 2014-139052 | 7/2014 |
| JP | 5881078 | 3/2016 |
| JP | 2016-052194 | 4/2016 |
| JP | 6076950 | 2/2017 |
| JP | 6080944 | 2/2017 |
| WO | 2016/017740 | 2/2016 |

OTHER PUBLICATIONS

Written Opinion of the International Searching Authority dated May 19, 2020 in International Application No. PCT/JP2020/006587 (English Translation).

* cited by examiner

FIG. 3

58

| STATE NUMBER | STATE[ON-RAIL TRAINS OF CLOSED SECTIONS B1 TO B5 OR RESERVATION STATUS] | | | | | ACTION OF OWN TRAIN |
|---|---|---|---|---|---|---|
| | B1 | B2 | B3 | B4 | B5 | |
| 1 | OTHER TRAIN T2 | — | — | — | OWN TRAIN | RESERVE B2 |
| 2 | OTHER TRAIN T2 | RESERVATION (OWN TRAIN) | — | — | OWN TRAIN | RESERVE B3 |
| 3 | OTHER TRAIN T2 | RESERVATION (OWN TRAIN) | RESERVATION (OWN TRAIN) | — | OWN TRAIN | MOVE TO B3 |
| 4 | OTHER TRAIN T2 | RESERVATION (OWN TRAIN) | OWN TRAIN | — | — | MOVE TO B2 |
| 5 | OTHER TRAIN T2 | OWN TRAIN | — | — | — | RESERVE B3 |
| ... | ... | ... | ... | ... | ... | ... |
| 12 | OTHER TRAIN T2 | RESERVATION (OTHER TRAIN T2) | — | — | OWN TRAIN | STANDBY |
| 13 | — | OTHER TRAIN T2 | — | — | OWN TRAIN | STANDBY |
| 14 | — | OTHER TRAIN T2 | RESERVATION (OTHER TRAIN T2) | — | OWN TRAIN | STANDBY |
| ... | ... | ... | ... | ... | ... | ... |

TRAIN CONTROL DEVICE, METHOD, AND PROGRAM

TECHNICAL FIELD

The present invention relates to a train control device, a method, and a program. Priority is claimed on Japanese Patent Application No. 2019-118980, filed Jun. 26, 2019, the content of which is incorporated herein by reference.

BACKGROUND ART

A train operation control apparatus disclosed in Patent Document 1 generates control commands for signals which are installed at start points of respective blocked sections of a railroad line and connected via a network, as control targets, and transmits the control commands to each signal. The train operation control apparatus disclosed in Patent Document 1 includes a state information recording unit, a signal control unit, a control command recording unit, and an input/output control unit. The state information recording unit acquires, via the network, state information of the signals, current position information of a train obtained from a train position information source, and state information of a facility provided in a specific blocked section of the railroad line, and records the acquired information in a log file. Furthermore, the signal control unit acquires the latest state information of the signals, current position information of the train, and state information of the facility from the log file, and generates a control command for the signal. Furthermore, the control command recording unit records the generated control command and a manual operation control command, which is transmitted from a terminal, in the log file. Furthermore, the input/output control unit transmits the control command generated by the signal control unit to the signal via the network. Then, the signal control unit specifies, as reservation target blocked sections, a plurality of blocked sections where the signals need to be collectively controlled, on the basis of an operation diagram of the train, the plurality of blocked sections including a blocked section to which the train is to travel and which is located next to a blocked section where the train exists. Then, on the basis of the latest state information of the signals, current position information of the train, and state information of the facility acquired from the log file via the network, when there is no blocked section where a train is prevented from passing in all blocked sections belonging to the reservation target blocked sections, the signal control unit controls all signals, which exist at the start points of all the blocked sections among the reservation target blocked sections, by using passage permission signals.

CITATION LIST

Patent Literature

[Patent Document 1]
Japanese Patent No. 5881078

SUMMARY of Invention

Technical Problem

In the train operation control apparatus disclosed in Patent Document 1, operation control is performed on the basis of the result of determining whether it is possible to pass through a plurality of blocked sections. In such a configuration, for example, when an optimum solution is obtained in a case where the degree of freedom of operation control is large, there is a problem in that the calculation cost increases such as an increase in the calculation time. That is, for example, in a case where there are a plurality of combinations of control states in which passage is possible, when an optimum solution such as a combination of control states having the shortest passage time is to be calculated, there is a problem in that the calculation cost increases such as an increase in the calculation time.

The present invention provides a train control device, a method, and a program, which is possible to prevent the calculation cost related to train control from increasing.

Solution to Problem

An aspect of the present invention is a train control device, which controls trains by using an environmental model that is defined by the number of a plurality of closed sections constituting a track included in a predetermined control target region, a connection configuration of the closed sections, and the number of trains present on the track, a state of the environmental model being changed discretely according to a combination of a position of one control target train that is the train to be controlled, positions of zero or more other trains, and presence or absence of reservation for each of the closed sections, and the train control device includes: a control logic generation unit configured to generate a control logic that is a logic for selecting any one of actions of "reservation of a closed section or release of the reservation", "movement to a reserved closed section", and "standby in a current closed section", which are to be performed by the control target train depending on the state of the environmental model, and transitioning the state of the environmental model depending on the selection result, so as to satisfy a predetermined condition that is a condition for passing through the control target region; an action determination unit configured to sequentially determine the actions, which are to be performed by the control target train depending on the state of the environmental model, on the basis of the generated control logic until the predetermined condition is satisfied; and a regeneration instruction unit configured to instruct the control logic generation unit to regenerate the control logic with a present state of the environmental model as an initial state before the predetermined condition is satisfied.

Furthermore, an aspect of the present invention is the above train control device, and the predetermined condition may include a condition to be reached as a target state and a condition that has to not be reached.

Furthermore, an aspect of the present invention is the above train control device, and the control logic may include information indicating correspondence between a flow of a state transition of each of the closed sections included in the control target region and each of the actions to be sequentially performed by the control target train.

Furthermore, an aspect of the present invention is the above train control device, and the regeneration instruction unit may instruct the control logic generation unit to regenerate the control logic at a time when the state of the environmental model changes a plurality of times.

Furthermore, an aspect of the present invention is the above train control device, and when the environmental model has changed, the regeneration instruction unit may instruct the control logic generation unit to regenerate the control logic by using the changed environmental model.

Furthermore, an aspect of the present invention is the above train control device, and the control logic generation unit may separately generate the control logics for a plurality of partial control regions into which the control target region is divided, and the regeneration instruction unit may instruct the control logic generation unit to regenerate the control logic when the other train enters from a region other than the partial control region where the control target train is present or when the other train leaves from the partial control region where the control target train is present.

Furthermore, an aspect of the present invention is the above train control device, and the train control device may further include an additional generation instruction unit configured to, when the control target train approaches the other partial control region different from the partial control region where the control target train is present, instruct the control logic generation unit to generate a control logic for the other partial control region in addition to generation of the control logic for the partial control region where the control target train is present.

Furthermore, an aspect of the present invention is the above train control device, and the train control device may further include a region redefinition unit configured to redefine the partial control region according to the position of the control target train.

Furthermore, an aspect of the present invention is the above train control device, and the train control device may be mounted on the train.

Furthermore, an aspect of the present invention is a method, which controls trains by using an environmental model that is defined by the number of a plurality of closed sections constituting a track included in a predetermined control target region, a connection configuration of the closed sections, and the number of trains present on the track, a state of the environmental model being changed discretely according to a combination of a position of one control target train that is the train to be controlled, positions of zero or more other trains, and presence or absence of reservation for each of the closed sections, and includes: a step of selecting any one of actions of "reservation of a closed section or release of the reservation", "movement to a reserved closed section", and "standby in a current closed section", which are to be performed by the control target train depending on the state of the environmental model, so as to satisfy a predetermined condition that is a condition for passing through the control target region; a step of generating a control logic that is a logic for transitioning the state of the environmental model depending on the selection result; a step of sequentially determining the actions, which are to be performed by the control target train depending on the state of the environmental model, on the basis of the generated control logic until the predetermined condition is satisfied; and a step of regenerating the control logic with a present state of the environmental model as an initial state before the predetermined condition is satisfied.

Furthermore, an aspect of the present invention is a program causing a computer, which constitutes a device for controlling trains to perform a method of controlling the trains by using an environmental model that is defined by the number of a plurality of closed sections constituting a track included in a predetermined control target region, a connection configuration of the closed sections, and the number of trains present on the track, a state of the environmental model being changed discretely according to a combination of a position of one control target train that is the train to be controlled, positions of zero or more other trains, and presence or absence of reservation for each of the closed sections, the method including: a step of selecting any one of actions of "reservation of a closed section or release of the reservation", "movement to a reserved closed section", and "standby in a current closed section", which are to be performed by the control target train depending on the state of the environmental model, so as to satisfy a predetermined condition that is a condition for passing through the control target region; a step of generating a control logic that is a logic for transitioning the state of the environmental model depending on the selection result; a step of sequentially determining the actions, which are to be performed by the control target train depending on the state of the environmental model, on the basis of the generated control logic until the predetermined condition is satisfied; and a step of regenerating the control logic with a present state of the environmental model as an initial state before the predetermined condition is satisfied.

Advantageous Effects of Invention

According to respective aspects of the present invention, since a control logic can be updated during train operation, the control logic can be generated without increasing the calculation cost as compared to a case where a control logic is not updated with an efficient control logic.

BRIEF DESCRIPTION OF DRAWINGS

FIG. 3 is a schematic diagram showing a configuration example of a control logic 58 shown in FIG. 2.

DESCRIPTION OF EMBODIMENTS

Figure 1:
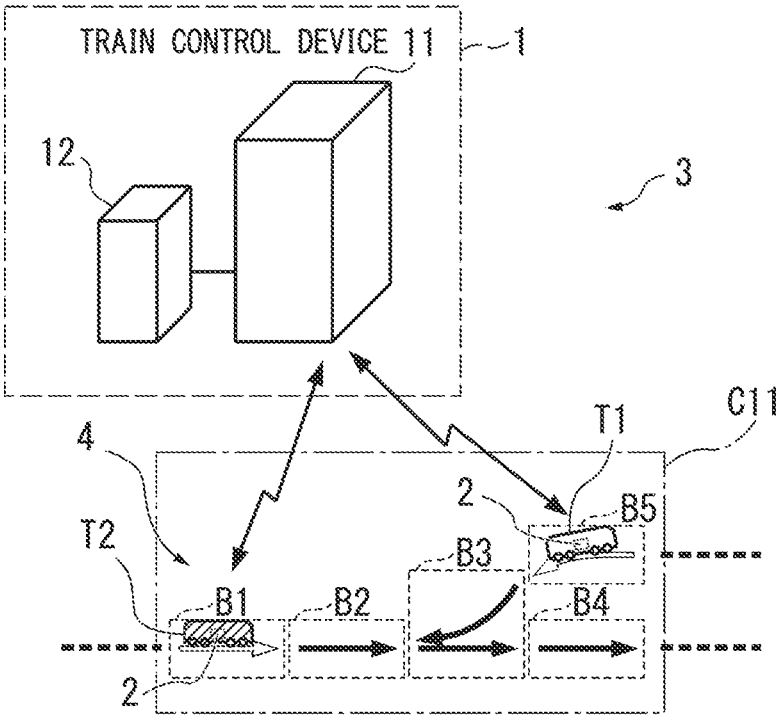
FIG. 1 is a configuration diagram showing a configuration example of a train control device according to an embodiment of the present invention.

Hereinafter, embodiments of the present invention are described with reference to the drawings. In the drawings, the same reference numerals are used for the same or corresponding configurations, and description thereof will be appropriately omitted.

First Embodiment

A first embodiment of the present invention is described. FIG. 1 is a configuration diagram showing a configuration example of the train control device 1 according to an embodiment of the present invention. In FIG. 1, a track system 3 includes the train control device 1, a track (also referred to as a "track line") 4, one or a plurality of trains T1 and T2, and the like. The track 4 is composed of a plurality of closed sections ("closed sections" are also referred to and described as "closed blocks" (blocks)) B1, B2, B3, B4, B5, and the like. Each of the trains T1 and T2 is composed of one or a plurality of vehicles running on the track 4. Each of the trains T1 and T2 includes on-train devices 2.

The closed section is a section where only one train is allowed to enter. Furthermore, when a train enters a certain closed section, the closed section needs to be reserved prior to entry and the train can enter the closed section when the reservation can be made. Only one train is allowed to reserve each closed section.

The train control device 1 includes a central control device 11 and a calculating machine 12. The central control device 11 is composed of one or a plurality of computers and peripheral devices thereof, and remotely controls the trains T1 and T2 by logic control (discrete control) on the basis of position information of the trains T1 and T2. The central control device 11 receives the position information of the trains T1 and T2 transmitted by the on-train devices 2, and transmits a control command to the trains T1 and T2 according to a control logic generated in advance on the basis of the received position information of the trains T1 and T2, thereby logically controlling the trains T1 and T2. The control logic is a logic control program (details are described below). The calculating machine 12 calculates and generates the control logic. At this time, the train control device 1 sets a predetermined region on the track 4 as a control target region C11, and generates the control logic for each specific train to be controlled (control target train) located in the control target region C11. In the example shown in FIG. 1, the control target region C11 includes the closed sections B1, B2, B3, B4, and B5. In such a case, the closed section B3 is a part where one line is branched into two lines, and is regarded as one closed section including the branched part. The arrow in a broken line block indicating the closed section indicates the direction in which a train in the closed section will run next.

The closed section B1 is connected to the closed section B2, the closed section B2 is connected to the closed section B3, and the closed section B3 is connected to the closed section B4 and the closed section B5 via the branch part. Furthermore, the train T2 is located in the closed section B1 and the train T1 is located in the closed section B5. Furthermore, from the closed section B1, movement in the direction of the closed section B2 indicated by the white arrow is permitted. From the closed section B2, movement in the direction of the closed section B3 indicated by the black arrow is permitted. From the closed section B3, a train entering from the closed section B2 is allowed to move in the direction of the closed section B4 and a train entering from the closed section B5 is allowed to move in the direction of the closed section B2. From the closed section B5, movement in the direction of the closed section B3 indicated by the white arrow is permitted. The white arrow indicates a state in which the closed section is reserved, and the black arrow indicates a state in which the reservation for the closed section is released.

In the present embodiment, in an "environmental model" composed of the track 4 divided into the plurality of closed sections B1 to B5, one control target train (hereinafter, the train T1 is referred to as a control target train T1) present on the track 4, and zero or more other trains (hereinafter, the train T2 is referred to as other train T2) present on the same track 4, the control logic is a logic to determine an action of the control target train T1 from "reservation of a closed section or release of the reservation", "movement to a reserved closed section", and "standby in a current closed section" on the basis of the positional relationship between the trains T1 and T2 and the reservation status of a closed section (state of the environmental model). In such a case, the environmental model is a model representing an environment of the control target, and is defined by the number (five in such a case) of the plurality of closed sections B1 to B5 constituting the track 4 included in the predetermined control target region C11, a connection configuration of the closed sections (relationship between the connection of the closed sections B1 to B5 and traveling direction), and the number (two in such a case) of trains present on the track 4. Furthermore, the state of the environmental model changes discretely according to a combination of the position (the closed section B5 in such a case) of one control target train T1 that is a train to be controlled, the position (the closed section B1 in such a case) of zero or more other trains T2, the presence or absence of reservation for each closed section, and the like. Hereinafter, the control target train T1 may be called own train (relative to another train T2). Furthermore, among information that defines the environmental model, information indicating the number of closed sections forming a track and a connection configuration of the closed sections may be called track route information.

Furthermore, in the present embodiment, the control logic needs to satisfy a Safety condition (safety condition) and a goal condition.

The Safety condition is, for example, a condition that has to not be reached under any circumstances such as "no matter what kind of movement other trains make, a dangerous result such as a collision does not occur" and "a control target train does not fall into a deadlock which makes movement impossible irrespective of the control".

The goal condition is, for example, a condition that has to be reached as a target state such as "reaching a designated station after leaving a train shed" and "reaching a specific closed section in the control target region". The goal condition may include a combination of a plurality of target states such as "after satisfying a certain intermediate state, another final state is reached".

A specific example in the present embodiment is based on the premise that the condition that only one train is allowed to enter a certain closed section is guaranteed by another safety system such as signal control. Thus, no collision occurs, and a control logic targeted by the present embodiment aims to "achieve the goal condition without falling into a deadlock". That is, in the present embodiment, the control logic is generated so as to satisfy a predetermined condition that is a condition for passing through a control target region. The predetermined condition includes a condition that needs to be reached as a target state of "achieving the goal condition" and a condition that has to not be reached that is "not falling into a deadlock". Furthermore, the control logic includes information indicating the correspondence between the flow of a state transition of each closed section included in the control target region and each action sequentially performed by the control target train.

The present embodiment has no concept of continuous time, and deals with only the control logic in a discrete state transition in which a state discontinuously transitions each time a step is performed. Furthermore, in the present embodiment, although when a train moves between closed sections, there can be no intermediate state in which one train straddles two closed sections at the same time, a discrete state transition including such an intermediate state may be allowed by defining a state in which one train straddles two closed sections at the same time as one discrete state.

The control logic presents an action to be taken by the control target train according to the state of the environmental model. A control logic, which presents a plurality of actions that may be taken by the control target train for achieving the goal condition (actions that can reach the goal condition), may be generated. In actual operation, only one action is selected and executed from the plurality of presented actions by some methods.

In the present embodiment, the "environmental model" and the "control logic" can be summarized as follows. That is, in the present embodiment, the "environmental model" is defined by (1) the number of closed sections forming a track and the connection configuration (connection form) of the closed sections and (2) the number of trains present on the track. Furthermore, the "environmental model" has a discrete state (or makes a discrete state transition) based on a combination of the position of a control target train, the position of other train, the presence or absence of reservation for each closed section (reservation for own train or reservation for other train), and the like. For example, a certain state (1) is that "the position of the control target train is OO, the position of another train (1) is xx, . . . , the closed section (1) is not reserved, closed section (2) is not reserved, . . . ". Furthermore, another state (2) is that "the position of the control target train is ΔΔ, the position of the other train (1) is ⊏⊏, . . . , the closed section (1) is not reserved, the closed section (2) is reserved for the other train (1), . . . ". The state of the "environmental model" is defined for each train. For example, when there are three trains (trains (A), (B), and (C)), the state of an environmental model used for controlling the train (A) is determined by (a) the position of a control target train (train (A)), (b) the positions of other trains (trains (B) and (C)), (c) the presence or absence of reservation for own train (train (A)) in each closed section, and (d) the presence or absence of reservation for other trains (trains (B) and (C)) in each closed section. Furthermore, the state of an environmental model used for controlling the train (B) and the state of an environmental model used for controlling the train (C) are also the same.

Furthermore, in the present embodiment, the "control logic" is a logic that determines any one of the actions of "reservation of a closed section or release of the reservation", "movement to a reserved closed section", and "standby in a current closed section" with respect to the control target train depending on the state of the "environmental model", and transitions the state of the "environmental model". Furthermore, the "control logic" is generated so that (1) the control target train reaches a target closed section from a current closed section and (2) no deadlock occurs.

In the present embodiment, the "control logic" can be automatically generated using a model transition system analyzer (MTSA) and the like that are tools released as open sources. The MTSA is an automatic generation tool jointly developed by Imperial College London (Distributed Software Engineering (DSE) Group at Imperial College London) and University of Buenos Aires (the Laboratory on Foundations and Tools for Software Engineering (LaFHIS) at the University of Buenos Aires, uses an environmental model formally described and requirements as input, and automatically generates a specification model (state of the environmental model), whose correctness is guaranteed, on the basis of game theory (URL: http://mtsa.dc.uba.ar). However, the present invention is not limited thereto and the "control logic" may be generated using a program that combines processes of performing a plurality of condition determinations, for example, as disclosed in Patent Document 1.

Figure 16:
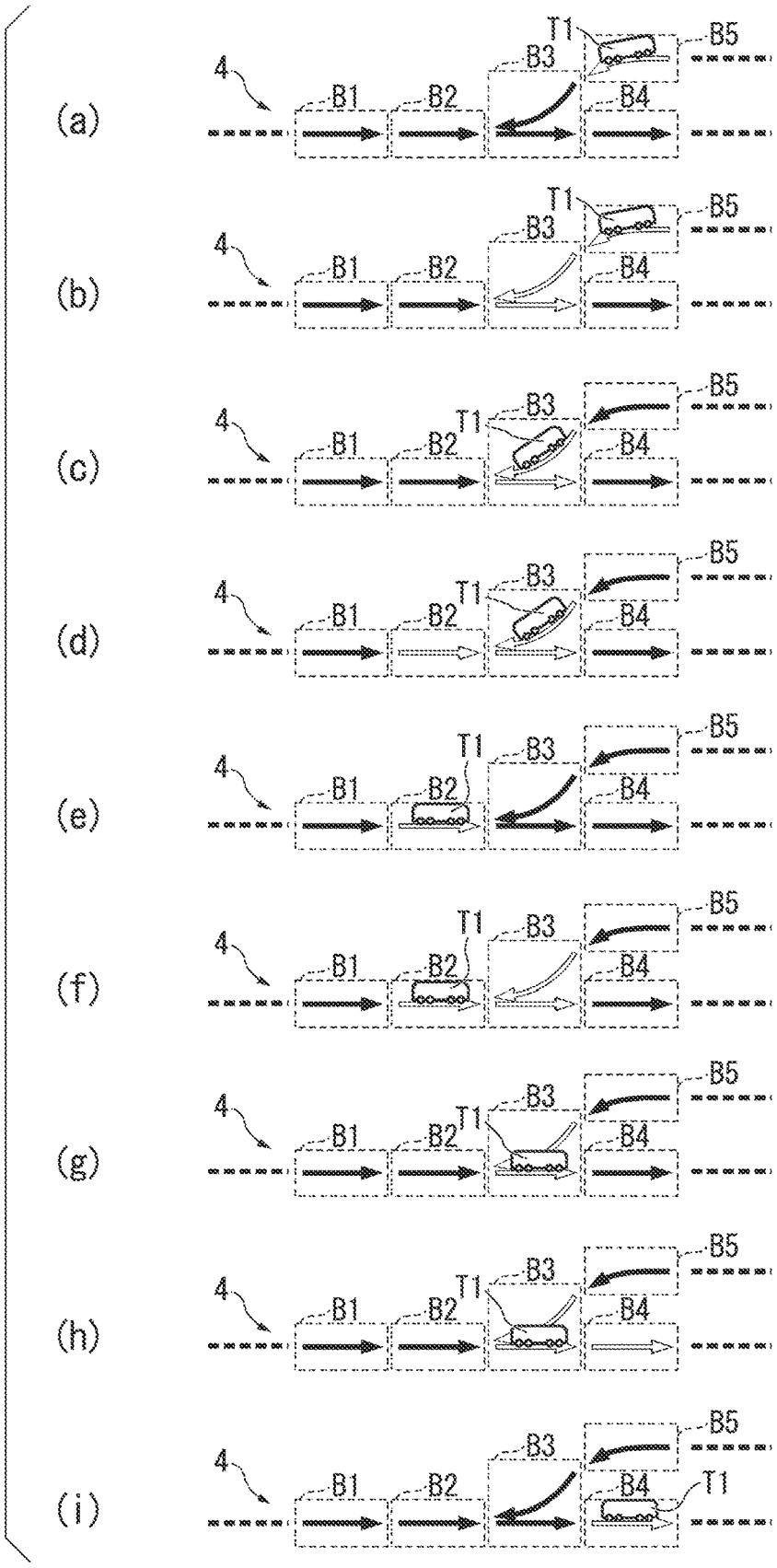
FIG. 16 is a schematic diagram used for explaining the train control device 1 shown in FIG. 1.
Figure 17:
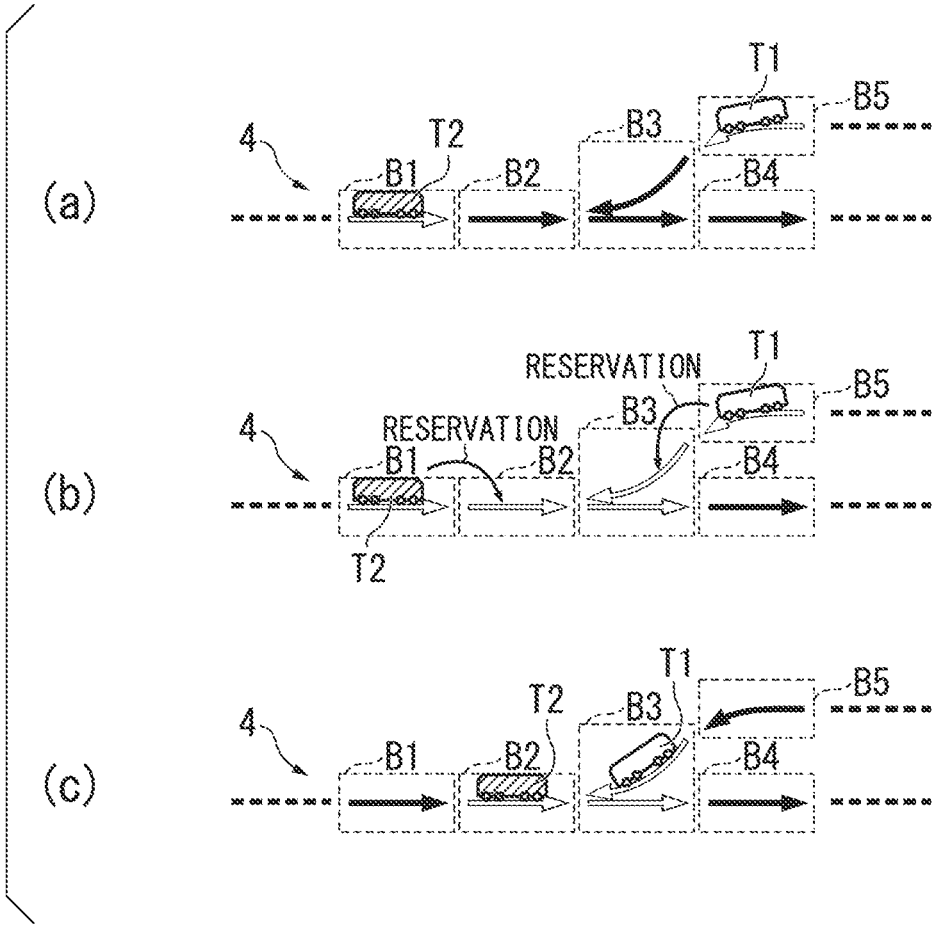
FIG. 17 is a schematic diagram used for explaining the train control device 1 shown in FIG. 1.
Figure 18:
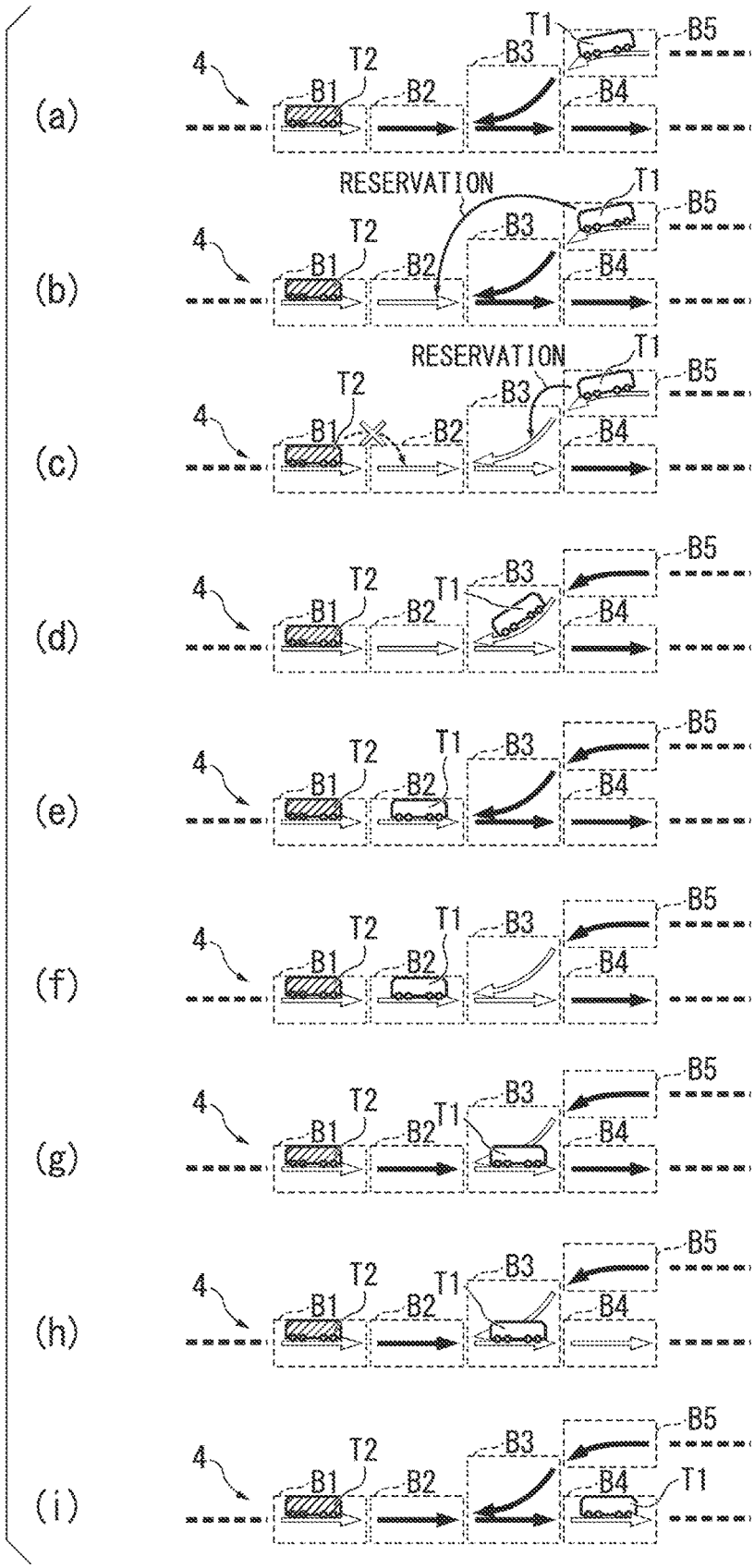
FIG. 18 is a schematic diagram used for explaining the train control device 1 shown in FIG. 1.

Next, examples of logic control (discrete control) according to the present embodiment are described with reference to FIG. 16 to FIG. 18. FIG. 16 to FIG. 18 are schematic diagrams used for explaining the train control device 1 shown in FIG. 1.

(a) to (i) of FIG. 16 indicate a control procedure with the minimum number of state transitions for achieving the goal condition that when only the control target train T1 is present on the track 4, "the train T1 in the closed section B5 moves to the closed section B4". The closed section including the white arrow is a closed section reserved for entry and trains other than a train that has made a reservation are not allowed to enter. Furthermore, in such an example, in order to move from the closed section B3 including a branch to the closed section B4 on the right side, the train T1 needs to enter the closed section B2 once, turn around, enter the closed section B3 again, and then enter the closed section B4.

(a) of FIG. 16 indicates a state in which the control target train T1 is located in the closed section B5 and the closed section B5 is reserved for the control target train T1. (b) of FIG. 16 indicates a state in which the control target train T1 is located in the closed section B5 and the closed section B5 and the closed section B3 are reserved for the control target train T1. (c) of FIG. 16 indicates a state in which the control target train T1 moves to the closed section B3, the closed section B3 is reserved for the control target train T1, and the reservation for the closed section B5 is released. (d) of FIG. 16 indicates a state in which the control target train T1 is located in the closed section B3 and the closed section B3 and the closed section B2 are reserved for the control target train T1. (e) of FIG. 16 indicates a state in which the control target train T1 moves to the closed section B2, the closed section B2 is reserved for the control target train T1, and the reservation for the closed section B3 is released. (f) of FIG. 16 indicates a state in which the control target train T1 is located in the closed section B2 and the closed section B2 and the closed section B3 are reserved for the control target train T1. (g) of FIG. 16 indicates a state in which the control target train T1 moves to the closed section B3, the closed section B3 is reserved for the control target train T1, and the reservation for the closed section B2 is released. (h) of FIG. 16 indicates a state in which the control target train T1 is located in the closed section B3 and the closed section B3 and the closed section B4 are reserved for the control target train T1. (i) of FIG. 16 indicates a state in which the control target train T1 moves to the closed section B4, the closed section B4 is reserved for the control target train T1, and the reservation for the closed section B3 is released.

As a reference example, (a) to (c) of FIG. 17 indicate a state in which when the control target train T1 and one other train T2 are present on the track 4, both the trains T1 and T2 fall into a deadlock where they are not movable forever. In such a case, the deadlock occurs because the two trains T1 and T2 have reserved closed sections facing each other. However, in the present embodiment, such a control logic is not generated.

(a) of FIG. 17 indicates a state in which the control target train T1 is located in the closed section B5, the other train T2 is located in the closed section B1, the closed section B5 is reserved for the control target train T1, and the closed section B1 is reserved for the other train T2. (b) of FIG. 17 indicates a state in which the control target train T1 is located in the closed section B5, the closed section B5 and the closed section B3 are reserved for the control target train T1, the other train T2 is located in the closed section B1, and the closed section B1 and the closed section B2 are reserved for the other train T2. (c) of FIG. 17 indicates a state in which the control target train T1 moves to the closed section B3, the closed section B3 is reserved for the control target train T1, the reservation for the closed section B5 is released, while the other train T2 moves to the closed section B2, the closed section B2 is reserved for the other train T2, and the reservation for the closed section B1 is released.

(a) to (i) of FIG. 18 indicate an example in which when the control target train T1 and one other train T2 are present on the track 4, the goal condition is reached without deadlock. The control target train T1 reserves another closed section beyond the branch, so that a deadlock is avoided.

The number of vehicles constituting one train is one or more and has no upper limit, but it is assumed that the length of the train is shorter than that of the shortest closed section.

(a) of FIG. 18 indicates a state in which the control target train T1 is located in the closed section B5, the other train T2 is located in the closed section B1, the closed section B5 is reserved for the control target train T1, and the closed section B1 is reserved for the other train T2. (b) of FIG. 18 indicates a state in which the control target train T1 is located in the closed section B5, the other train T2 is located in the closed section B1, the closed section B5 and the closed section B2 are reserved for the control target train T1, and the closed section B1 is reserved for the other train T2. (c) of FIG. 18 indicates a state in which the control target train T1 is located in the closed section B5, the other train T2 is located in the closed section B1, the closed section B5, the closed section B2, and the closed section B3 are reserved for the control target train T1, and the closed section B1 is reserved for the other train T2. (d) of FIG. 18 indicates a state in which the control target train T1 moves to the closed section B3, the other train T2 is located in the closed section B1, the closed section B2 and the closed section B3 are reserved for the control target train T1, the closed section B1 is reserved for the other train T2, and the reservation for the closed section B5 is released. (e) of FIG. 18 indicates a state in which the control target train T1 moves to the closed section B2, the other train T2 is located in the closed section B1, the closed section B2 is reserved for the control target train T1, the closed section B1 is reserved for the other train T2, and the reservation for the closed section B3 is released. (f) of FIG. 18 indicates a state in which the control target train T1 is located in the closed section B2, the other train T2 is located in the closed section B1, the closed section B2 and the closed section B3 are reserved for the control target train T1, and the closed section B1 is reserved for the other train T2. (g) of FIG. 18 indicates a state in which the control target train T1 moves to the closed section B3, the other train T2 is located in the closed section B1, the closed section B3 is reserved for the control target train T1, the closed section B1 is reserved for the other train T2, and the reservation for the closed section B2 is released. (h) of FIG. 18 indicates a state in which the control target train T1 is located in the closed section B3, the other train T2 is located in the closed section B1, the closed section B3 and the closed section B4 are reserved for the control target train T1, and the closed section B1 is reserved for the other train T2. (i) of FIG. 18 indicates a state in which the control target train T1 moves to the closed section B4, the other train T2 is located in the closed section B1, the closed section B4 is reserved for the control target train T1, the closed section B1 is reserved for the other train T2, and the reservation for the closed section B3 is released.

Figure 2:
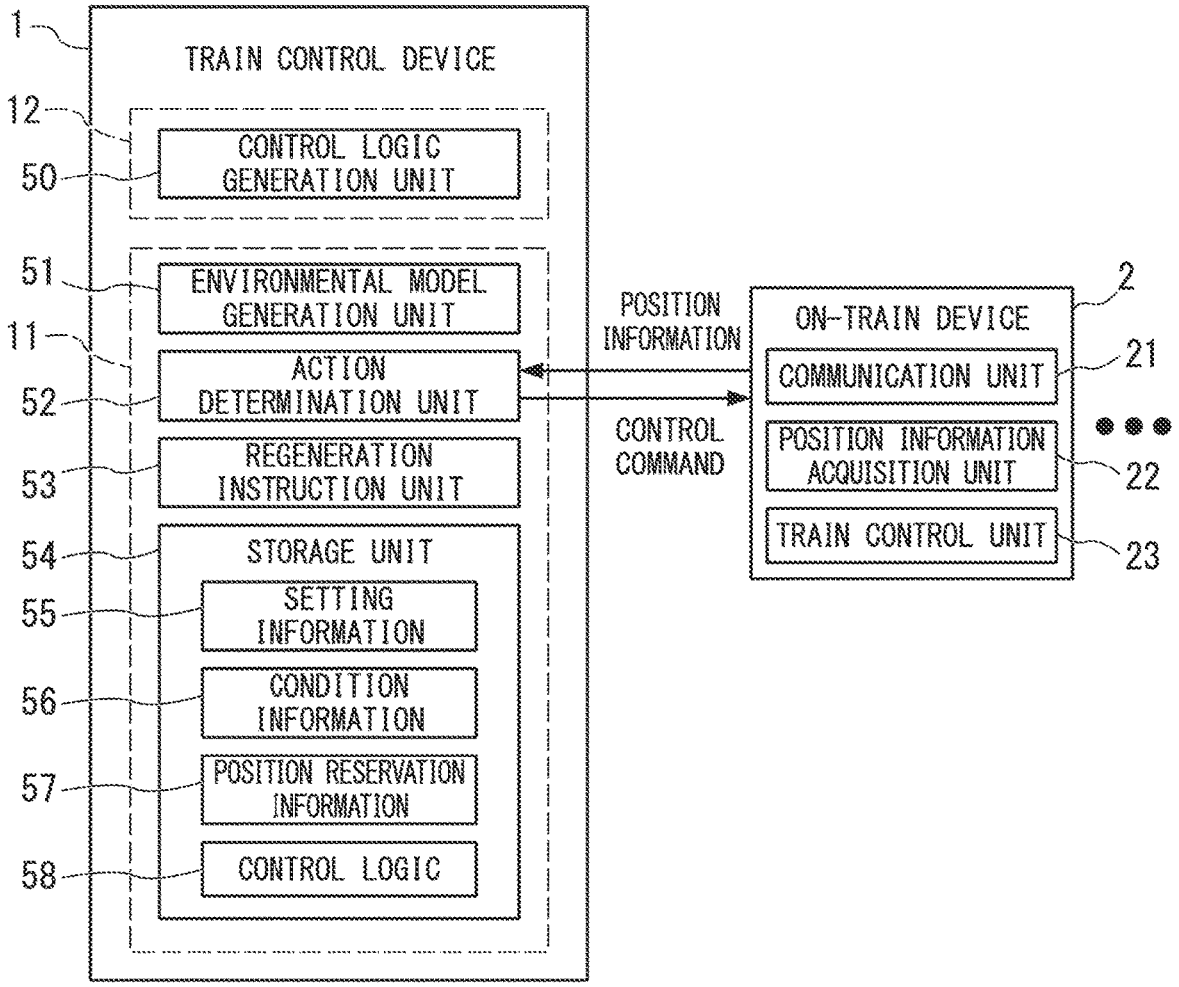
FIG. 2 is a block diagram showing a configuration example of the train control device 1 and an on-train device 2 shown in FIG. 1.

Next, a functional configuration example of the train control device 1 and an on-train device 2 shown in FIG. 1 is described with reference to FIG. 2. FIG. 2 is a block diagram showing the configuration example of the train control device 1 and an on-train device 2 shown in FIG. 1. As shown in FIG. 2, in the train control device 1, the calculating machine 12 includes a control logic generation unit 50. Furthermore, in the train control device 1, the central control device 11 includes an environmental model generation unit 51, an action determination unit 52, a regeneration instruction unit 53, and a storage unit 54. The control logic generation unit 50, the environmental model generation unit 51, the action determination unit 52, the regeneration instruction unit 53, and the storage unit 54 are functional components including a combination of hardware such as one or a plurality of computers constituting the calculating machine 12 and the central control device 11 and peripheral devices of the computers and software such as programs executed by the computers. Furthermore, the storage unit 54 stores setting information 55, condition information 56, position reservation information 57, and a control logic 58.

The setting information 55 includes various information used when an environmental model is generated. The various information includes, for example, the number of the plurality of closed sections B1 to B5 and the like constituting the track 4 included in the control target region C11 and the like, and the connection configuration (referred to as track route information) of the closed sections B1 to B5, information (referred to as train number information) on the number of trains T1, T2 and the like present on the track 4, and the like.

The condition information 56 includes information representing the Safety condition and the goal condition for each train, and the like.

The position reservation information 57 is information (referred to as train position information) representing the presence or absence of a train and if present, which trains is present for each closed section, information (referred to as block reservation information) representing the presence or absence of reservation, and the like, and includes information used as an initial value when a control logic is generated, information representing history of changes due to train control and the latest state, and the like.

The control logic 58 includes information representing a control logic for each train generated by the control logic generation unit 50. Hereinafter, a configuration example of the control logic 58 is described with reference to FIG. 3. FIG. 3 is a schematic diagram showing the configuration example of the control logic 58 shown in FIG. 2. FIG. 3 shows an example of the control logic 58 shown in the form of a state transition table. The control logic 58 shown in FIG. 3 is a logic for transitioning the state of an environmental model corresponding to the track 4 included in the control target region C11 shown in FIG. 1, and includes a series of control logics composed of state numbers 1, 2, 3, 4, 5, . . . and another series of control logics composed of state numbers 12, 13, 14, . . . . The series of control logics composed of the state numbers 1, 2, 3, 4, 5, . . . include information indicating a state transition and actions of the control target train T1 when the control target train T1 (written as "own train" in FIG. 3) is located in the closed section B5 (on rail), the other train T2 is located in the closed section B1, and the control target train T1 moves to the closed section B4 as a target position in an initial state as shown in (a) of FIG. 18. The state number 1 corresponds to (a) of FIG. 18, the state number 2 corresponds to (b) of FIG. 18, the state number 3 corresponds to (c) of FIG. 18, the state number 4 corresponds to (d) of FIG. 18, and the state number 5 corresponds to (e) of FIG. 18. According to the control logic 58 shown in FIG. 3, when the states of the closed sections B1 to B5 in the control target region C11 match the state of the state number 1, for example, an action of reserving the closed section B2 is selected. Then, when the states of the closed sections B1 to B5 match the state of the state number 2 subsequent to the execution of the action defined in the state number 1, an action of reserving the closed section B3 is selected. On the other hand, the series of control logics composed of the state numbers 12, 13, 14, . . . correspond to a case where the closed section B2 has been reserved by the other train T2, so the control target train T1 is not able to make a reservation and is on standby. The series of control logics composed of the state numbers 12, 13, 14, . . . include information indicating the content of a state transition and actions of the control target train T1 when the other train T2 moves to the closed section B4 as a target position before the control target train T1 in the case where the control target train T1 is located in the closed section B5, the other train T2 is located in the closed section B1, and the control target train T1 moves to the closed section B4 as a target position in an initial state as shown in (a) of FIG. 18. In the state numbers 12, 13, and 14, the control target train T1 is located in the closed section B5 and an action thereof is "standby".

In the control logic 58 shown in FIG. 3, a closed section where a train is on is always reserved by the on-rail train, and trains, other than the on-rail train, are not able to make a reservation. Furthermore, in the control logic 58 shown in FIG. 3, after the train moves, the reservation for the closed section where the train is on before the movement is released at the same time as the movement.

The environmental model generation unit 51 generates an environmental model that is defined by the number of the plurality of closed sections B1 to B5 constituting a track 4 included in the predetermined control target region C11, the connection configuration of the closed sections B1 to B5, and the number of trains T1 and T2 present on the track 4, the state of the environmental model being changed discretely according to a combination of the position of one control target train T1 that is a train to be controlled, the positions of zero or more other trains T2, and the presence or absence of reservation for each of the closed sections. The environmental model generation unit 51 generates the environmental model, for example, by generating an environmental model according to an input operation of an operator, or by reading a predetermined file prepared in advance and including information for generating the environmental model.

The control logic generation unit 50 uses, for example, the aforementioned MTSA and the like, uses the environmental model generated by the environmental model generation unit 51, and generates a control logic that is a logic that transitions the state of the "environmental model" by selecting any one of the actions of "reservation of a closed section or release of the reservation", "movement to a reserved closed section", and "standby in a current closed section", which are to be performed by the control target train depending on the state of the environmental model, so as to satisfy the predetermined Safety condition and goal condition. The control logic sequentially defines the state of each closed section defined in the environmental model and an action to be selected in that state, and the state of each closed section after the action is executed and an action to be selected in that state. The control logic generation unit 50 stores the generated control logic in the storage unit 54 as the control logic 58.

The action determination unit 52 acquires position information from the on-train device 2 of the control target train T1 (and the other train T2 and the like), sequentially determines actions, which are to be performed by the control target train T1 depending on the state of the environmental model, on the basis of the control logic generated by the control logic generation unit 50 until the goal condition is satisfied, and sequentially transmits a control command based on the determined action to the on-train device 2 of the control target train T1.

The regeneration instruction unit 53 instructs the control logic generation unit 50 to regenerate the control logic at least once before the goal condition is satisfied with the state of the environmental model at a present time as an initial state. For example, the regeneration instruction unit 53 instructs the regeneration of the control logic each time there is any state transition in the environmental model corresponding to the control target region C11.

On the other hand, the on-train device 2 shown in FIG. 2 includes a communication unit 21, a position information acquisition unit 22, and a train control unit 23. The communication unit 21 communicates with the train control device 1 via, for example, a train information collection system such as communication-based train control (CBTC), transmits the position information of the trains T1 and T2 and the like to the train control device 1, and receives the control command from the train control device 1. The position information acquisition unit 22 calculates the position of the own train by using, for example, wheel rotation information and the like with reference to a predetermined position on the track 4, and notifies the train control device 1 of the calculated position information via the communication unit 21 at a predetermined cycle, for example. The train control unit 23 controls a train driving device according to the control command received from the train control device 1 via the communication unit 21.

The position information of each train may be acquired by, for example, a device (not illustrated) installed on the track 4 and notified to the train control device 1.

Figure 4:
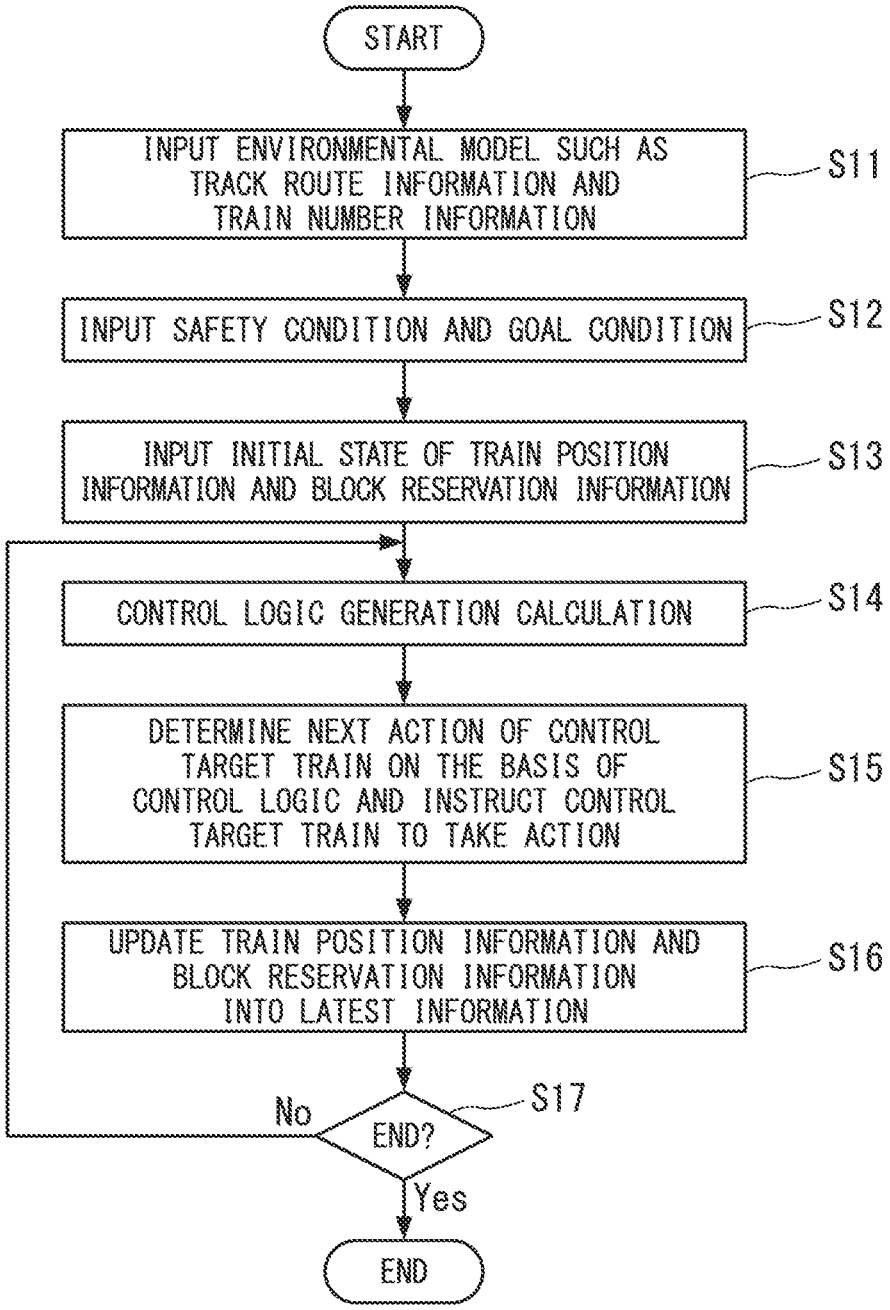
FIG. 4 is a flowchart showing an operation example (first embodiment) of the train control device 1 shown in FIG. 2.

Next, an operation example of the train control device 1 shown in FIG. 2 is described with reference to FIG. 4. FIG. 4 is a flowchart showing the operation example (first embodiment) of the train control device 1 shown in FIG. 2. When the process shown in FIG. 4 is started, first, the environmental model generation unit 51 sets definition information of an environmental model such as the track route information and the train number information and generates an environmental model according to an input operation of an operator or by reading the setting information 55 from the storage unit 54 (step S11). Next, for example, the action determination unit 52 (or processing flow control unit (not illustrated)) sets the Safety condition and the goal condition according to an input operation of an operator or by reading the condition information 56 from the storage unit 54 (step S12). Next, for example, the action determination unit 52 (or processing flow control unit (not illustrated)) sets the initial state of the train position information and the block reservation information according to an input operation of an operator or by reading the position reservation information 57 from the storage unit 54 (step S13).

Next, the control logic generation unit 50 sets the initial state set in step S13 as an initial state of an environmental model and generates a control logic by using the environmental model generated in step S11 and performing control logic generation calculation so as to satisfy the Safety condition and the goal condition set in step S12 (step S14).

Next, the action determination unit 52 determines a next action of the control target train T1 on the basis of the control logic generated in step S14, and instructs the control target train T1 to take an action (step S15).

Next, when there is a state transition in the environmental model, the action determination unit 52 updates the train position information and the block reservation information into the latest information (step S16). Next, the regeneration instruction unit 53 determines whether to end the process shown in FIG. 4 (step S17). When it is determined to end the process ("Yes" in step S17), the regeneration instruction unit 53 ends the process shown in FIG. 4, and when it is determined not to end the process ("No" in step S17), the regeneration instruction unit 53 returns to step S14, and instructs the control logic generation unit 50 to regenerate the control logic with the state of the environmental model at a present time as an initial state. In step S17, for example, when the goal condition is achieved, when train control on the day is completed, or when an operator performs an input operation of instructing the end, it is determined to end the process.

According to the operation shown in FIG. 4, a control logic based on the latest train position information is automatically generated in real time on the basis of real-time other train position information and block reservation information, and a control logic of a train is updated during operation. Furthermore, in the first embodiment, the automatic generation calculation and the update of the control logic are performed each time there is any state transition.

Incidentally, when it is possible to automatically generate a control logic capable of coping with all state transitions in the established environmental model, the control logic satisfies the Safety condition and the goal condition both before and after a control target train makes any state transition, so it is not necessary to newly generate a control logic during operation.

However, in order to keep the calculation time within a practical range, by taking measures to speed up calculation such as limiting the search range, a control logic that is "not always optimal" should be applied in some cases. The "not always optimal" corresponds to, for example, a control logic that completely satisfies the Safety condition and the goal condition, but may not be able to reach the goal with the minimum number of state transition steps.

The number of states up to the goal, which needs to be searched in control logic generation calculation after a certain state transition is fixed, is smaller than the number of states up to the goal that needs to be searched before the state transition is fixed, which causes an effect of improving the completeness of a state transition to be searched and shortening the calculation time and enables more accurate calculation. Thus, each time there is a state transition, it is possible to generate a control logic closer to the optimum.

Since the latest state is reflected in a control logic, a more appropriate (fewer state transition steps to the goal (and/or) faster time to reach the goal) control logic can be used, control becomes more efficient, and the operation cost reduction such as shortening of the operation time and power reduction is achieved, as compared to control based on a control logic generated before operation.

An exemplary practical calculation time for generating a control logic is within 24 hours in the case of pre-calculation when a general calculating machine for servers is used. Furthermore, when a control logic is updated during operation, an exemplary practical calculation time is shorter than the time for a train to move a closed section, for example, by a few seconds.

Second Embodiment

In the first embodiment, the regeneration instruction unit 53 shown in FIG. 2 sets the timing for updating a control logic after every state transition of the control target train T1, but in the second embodiment, the frequency of the timing for updating a control logic is reduced. The configuration of the second embodiment is the same as that of the first embodiment described with reference to FIG. 1 and FIG. 2, and the operation of the regeneration instruction unit 53 shown in FIG. 2 is partially different between the first embodiment and the second embodiment.

Figure 5:
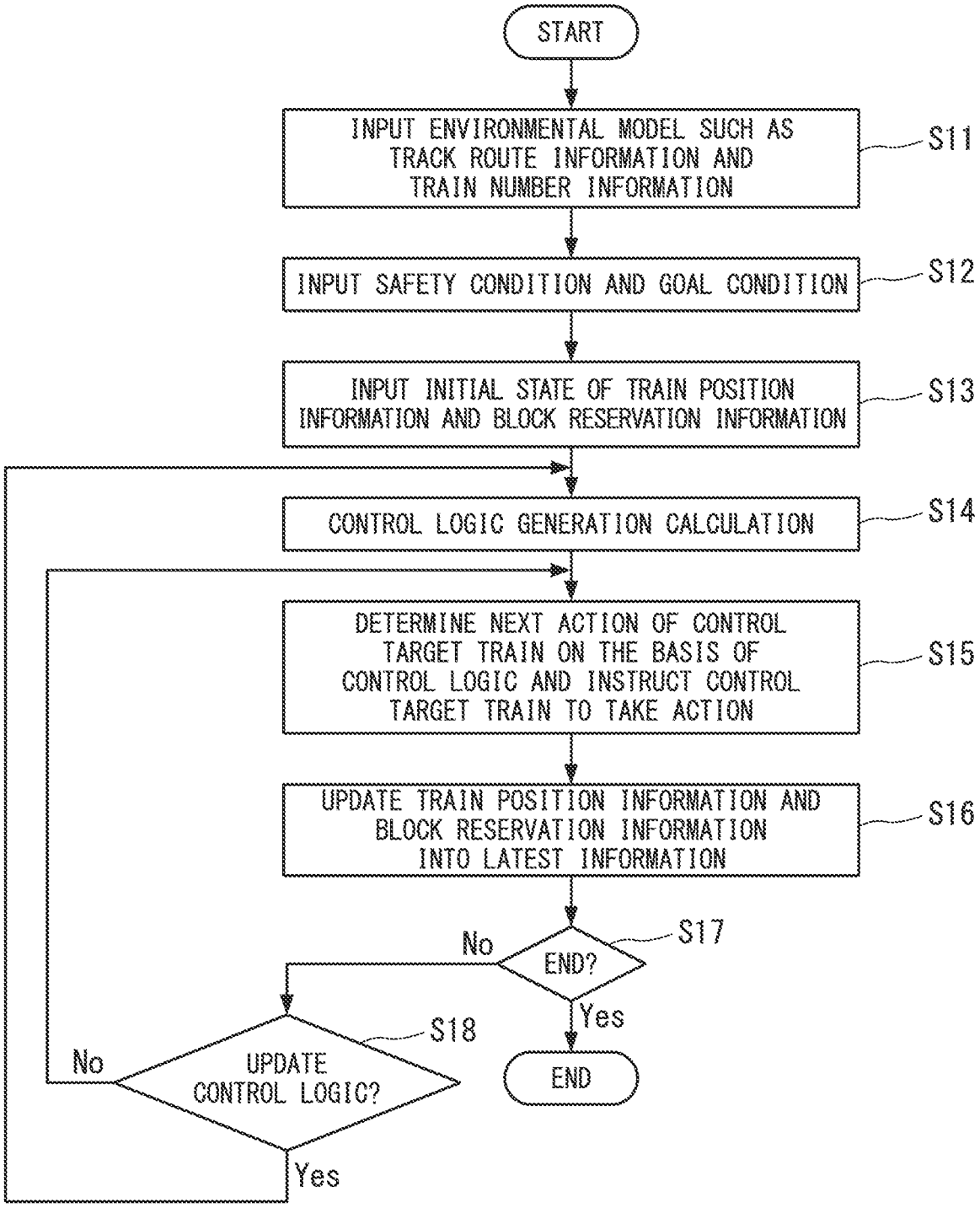
FIG. 5 is a flowchart showing another operation example (second embodiment) of the train control device 1 shown in FIG. 2.

FIG. 5 is a flowchart showing another operation example (second embodiment) of the train control device 1 shown in FIG. 2. In the process shown in FIG. 5, the process of step S18 is added to the process shown in FIG. 4. In the process shown in FIG. 5, the regeneration instruction unit 53 determines whether to end the process shown in FIG. 5 (step S17). When it is determined to end the process ("Yes" in step S17), the regeneration instruction unit 53 ends the process shown in FIG. 5, and when it is determined not to end the process ("No" in step S17), the regeneration instruction unit 53 determines whether to update the control logic in step S18.

In step S18, for example, after the control logic is generated (or is last updated), when there are the predetermined number of times of state transition in the environmental model, the regeneration instruction unit 53 determines to update the control logic. When the regeneration instruction unit 53 determines not to update the control logic ("No" in step S18), the action determination unit 52 determines a next action of the control target train T1 on the basis of the control logic generated in step S14, and instructs the control target train T1 to take an action (step S15). When it is determined to update the control logic ("Yes" in step S18), the regeneration instruction unit 53 returns to step S14, and instructs the control logic generation unit 50 to regenerate (that is, update) the control logic with the state of the environmental model at a present time as an initial state. In such a case, the regeneration instruction unit 53 instructs the control logic generation unit 50 to regenerate the control logic each time the state of the environmental model changes a plurality of times.

According to the second embodiment, the amount of calculation and the amount of communication can be reduced as compared to the case where a control logic is updated after every state transition as in the first embodiment.

Third Embodiment

The third embodiment is different from the first embodiment and the second embodiment in that a process of regenerating (redefining) an environmental model when there is a change in the environmental model is added. The configuration of the third embodiment is the same as those of the first embodiment and the second embodiment described with reference to FIG. 1 and FIG. 2, and in the third embodiment, the operation of the regeneration instruction unit 53 shown in FIG. 2 is partially different from that in the second embodiment. In the third embodiment, when there is a change in the environmental model, the regeneration instruction unit 53 instructs the control logic generation unit 50 to regenerate the control logic by using the changed environmental model.

Figure 6:
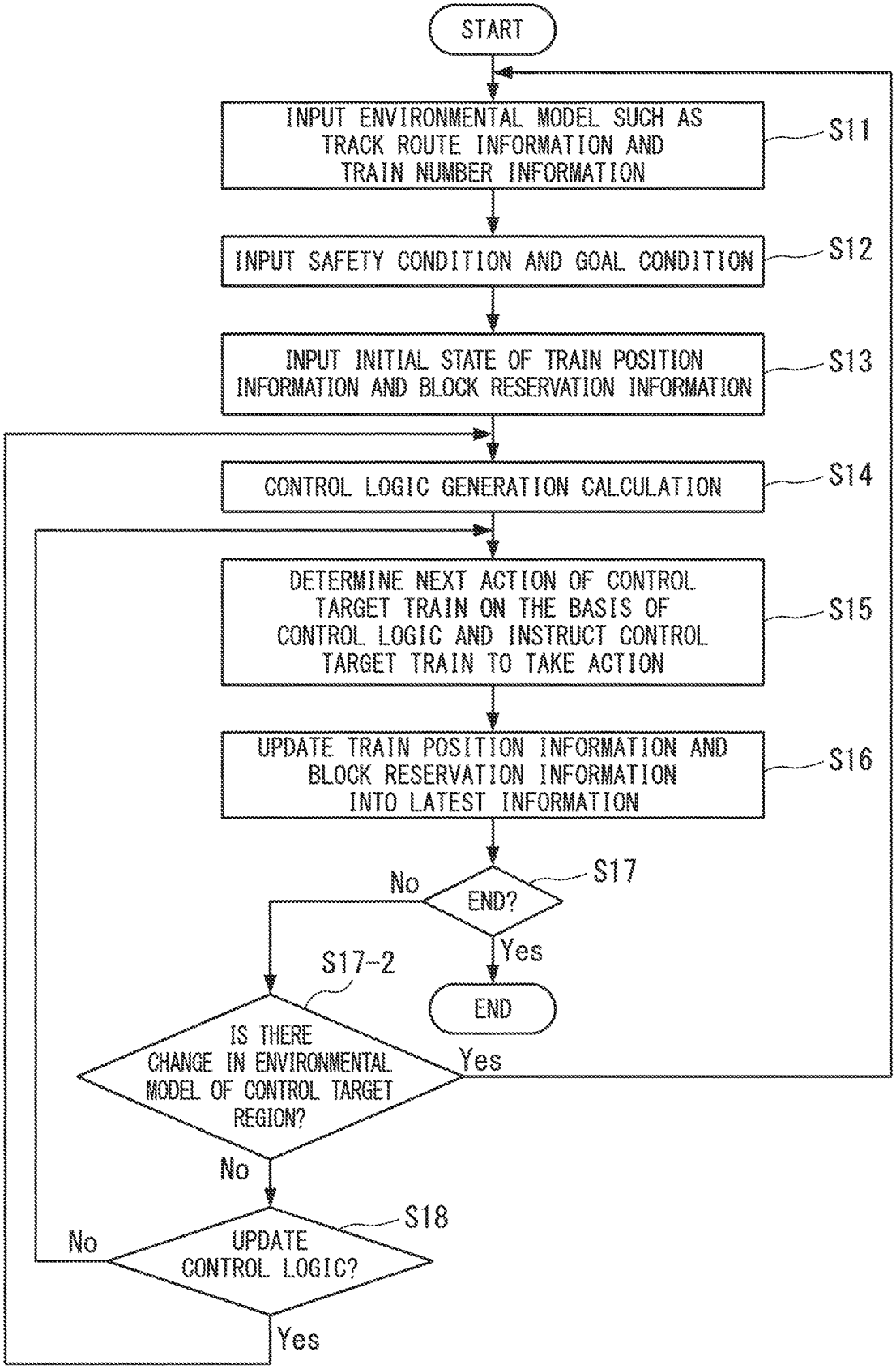
FIG. 6 is a flowchart showing another operation example (third embodiment) of the train control device 1 shown in FIG. 2.

FIG. 6 is a flowchart showing another operation example (third embodiment) of the train control device 1 shown in FIG. 2. In the process shown in FIG. 6, the process of step S17-2 is added to the process shown in FIG. 5 (the second embodiment). In the process shown in FIG. 6, the regeneration instruction unit 53 determines whether to end the process shown in FIG. 6 (step S17). When it is determined to end the process ("Yes" in step S17), the regeneration instruction unit 53 ends the process shown in FIG. 6, and when it is determined not to end the process ("No" in step S17), the regeneration instruction unit 53 determines whether there is a change in the environmental model of the control target region C11 in step S17-2. When there is a change in the environmental model ("Yes" in step S17-2), the regeneration instruction unit 53 returns the process to step S11, and when there is no change in the environmental model ("No" in step S17-2), the regeneration instruction unit 53 determines whether to update the control logic in step S18.

In the present embodiment, a change in the environmental model means a case that the environmental model which has not been initially expected to be changed and the change has not been considered as a precondition for control logic generation is changed, and the following abnormalities are mainly assumed: (1) when a train other than a control target train stops and is not operable due to an unexpected reason such as a breakdown or an accident and (2) one or a plurality of closed sections are not available due to an unexpected reason such as a breakdown or an accident.

Figure 7:
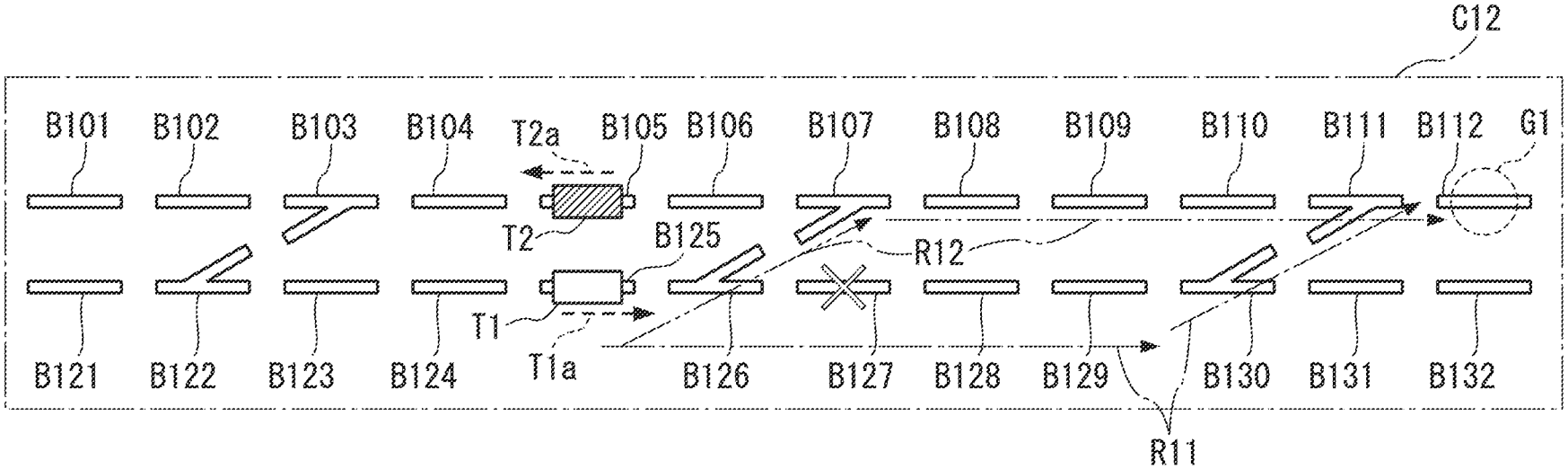
FIG. 7 is a schematic diagram for explaining the operation example (third embodiment) of the train control device 1 shown in FIG. 6.

For example, as shown in FIG. 7, when a closed section B127 is not available due to a rail breakage and the like, an initial route R11 passing through the closed section B127 is not available. In such a case, according to the third embodiment, an environmental model when the closed section B127 is removed from a control target region C12 is regenerated and a control logic is generated using the regenerated environmental model, so that it is possible to change the route to a new route R12 not passing through the closed section B127, for example.

FIG. 7 is a schematic diagram for explaining the operation example (third embodiment) of the train control device 1 shown in FIG. 6. FIG. 7 shows an example of updating to alternative route control when a closed section is not available. FIG. 7 schematically shows the control target region C12 including closed sections B101 to B112 and closed sections B121 to B132. In FIG. 7, the control target train T1 moves in the direction of an arrow T1*a* and the other train T2 moves in the direction of an arrow T2*a*. Furthermore, it is assumed that a goal condition G1 for the control target train T1 is to reach the closed section B112.

In the first embodiment and the second embodiment, a change in an environmental model is not taken into consideration, and at the time of abnormality, for example, control needs to be stopped. When the third embodiment is used, even at the time of abnormality in which there is an unexpected change in an environmental model, it is possible to generate control corresponding to the abnormality and to continue control that guarantees the Safety condition and the goal condition.

In order to enable control at the time of abnormality in the first embodiment, it is necessary to generate a control logic after considering all the cases of changes in the above environmental model in advance, so the calculation time for generating the control logic exceeds the practical time or the capacity of a calculating machine such as insufficient memory is exceeded, resulting in the problem of inability to calculate. Even when there is a change in the environmental model, when the third embodiment is used, the calculation for automatically generating a control logic at a higher speed becomes possible, and the calculation time falls within a practical range, which enables application to a product.

Regarding the occurrence of changes in the environmental model, for example, an operator manually inputs the occurrence to the train control device 1, the occurrence is automatically detected by a camera or a sensor provided on the on-train device 2 and the track 4 and is notified to the train control device 1, which makes it possible for the train control device 1 (the regeneration instruction unit 53) to recognize the occurrence.

Fourth Embodiment

Figure 9:
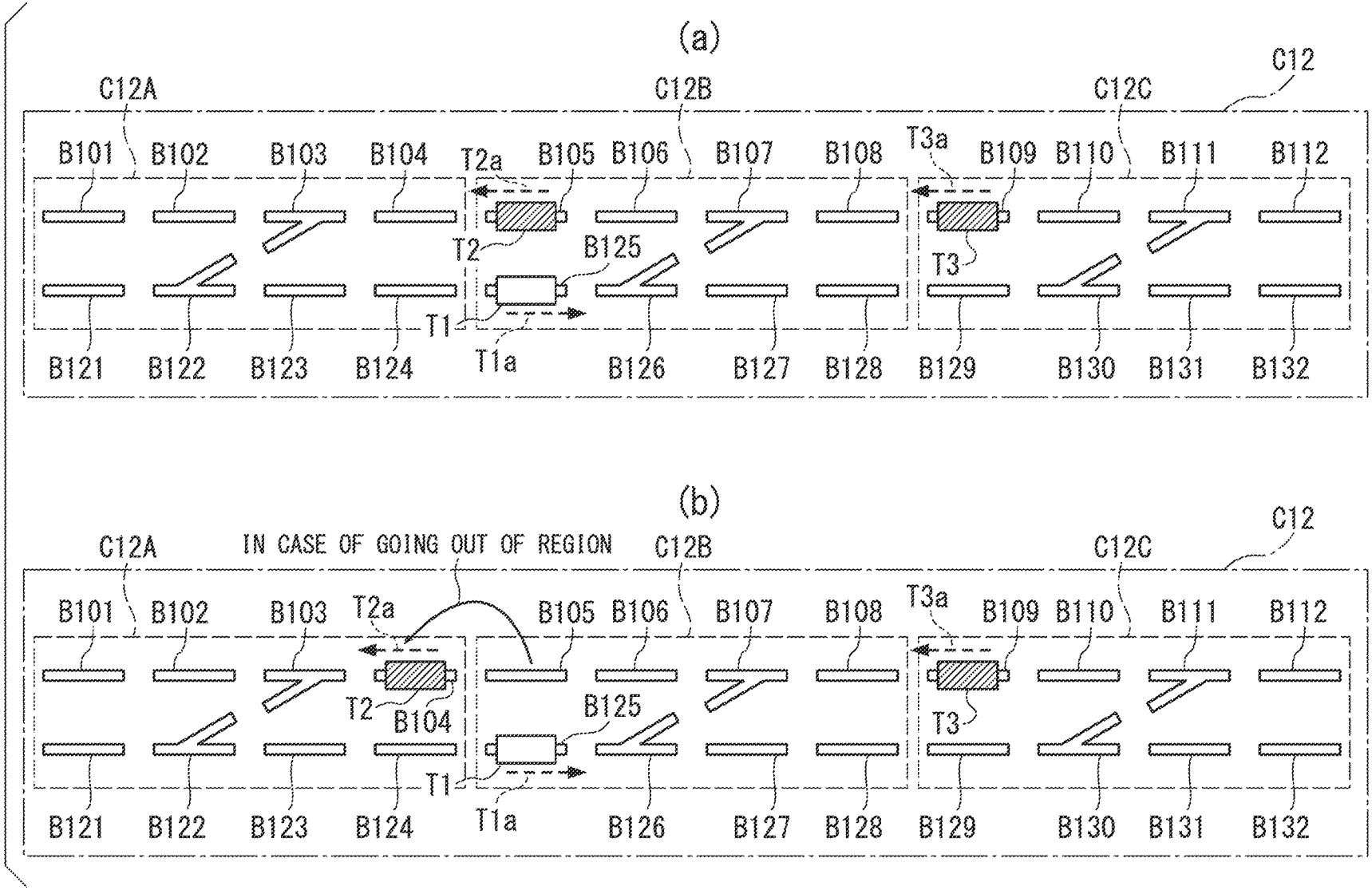
FIG. 9 is a schematic diagram for explaining the operation example (fourth embodiment) of the train control device 1 shown in FIG. 8.
Figure 10:
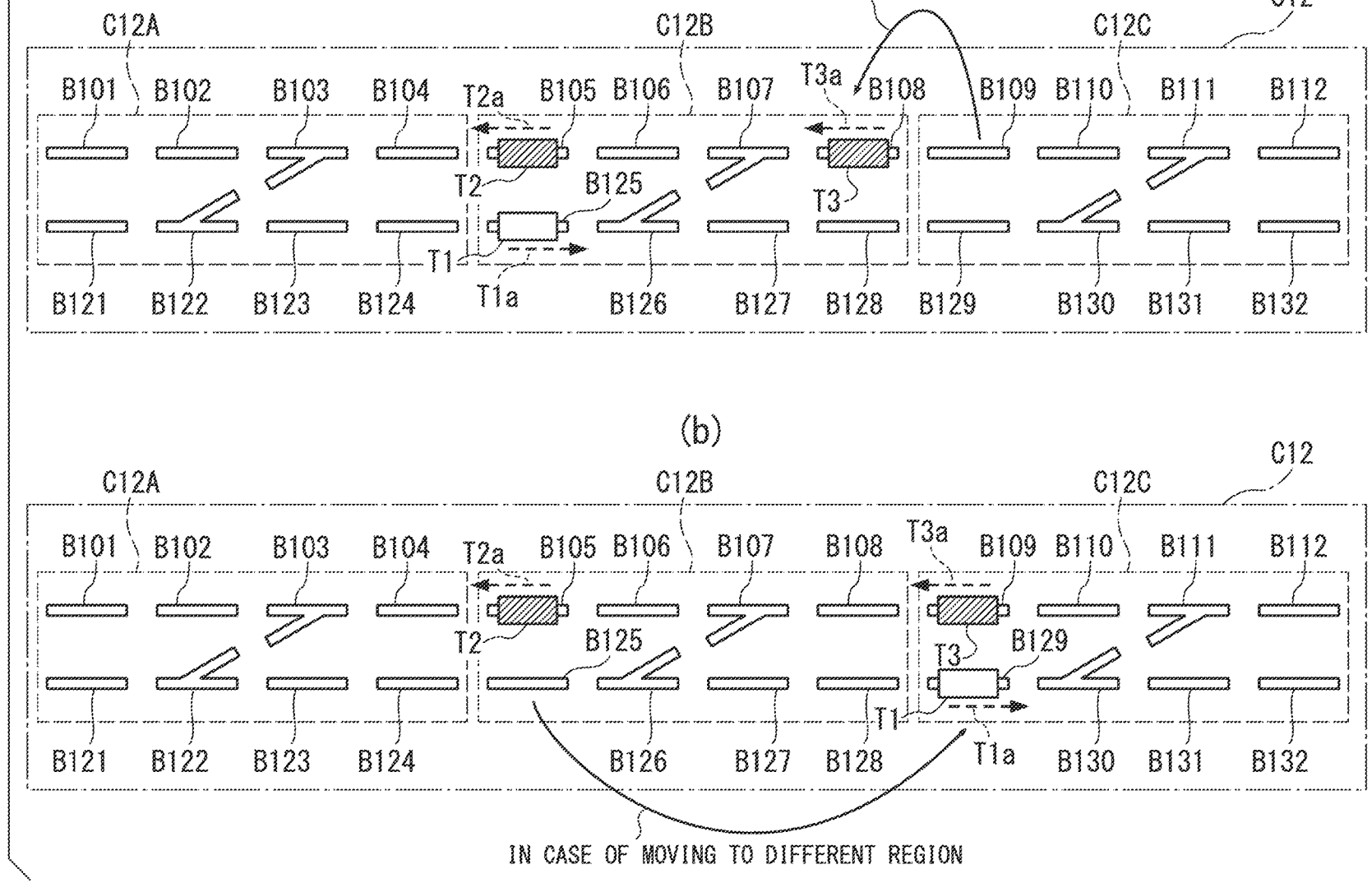
FIG. 10 is a schematic diagram for explaining the operation example (fourth embodiment) of the train control device 1 shown in FIG. 8.

Next, the fourth embodiment is described with reference to FIG. 8 to FIG. 10. The fourth embodiment is different from the first to third embodiments in that the control target region C12 described with reference to FIG. 7 is divided into three partial control regions C12A, C12B, and C12C as shown in FIG. 9 and FIG. 10 and the control logic generation unit 50 generates a control logic for each partial control region. In such a case, among the partial control regions C12A, C12B, and C12C, a region where the control target train T1 is located is a control target region.

In FIG. 9 and FIG. 10, the partial control region C12A includes closed sections B101 to B104 and closed sections B121 to B124. The partial control region C12B includes closed sections B105 to B108 and closed sections B125 to B128. The partial control region C12C includes closed sections B109 to B112 and closed sections B129 to B132. Furthermore, the control target train T1 and the other train T2 are located in the partial control region C12B and another train T3 is located in the partial control region C12C.

Furthermore, in (a) of FIG. 9, the control target train T1 is located in the closed section B125 and intends to move in the direction of an arrow T1*a*. Furthermore, the other train T2 is located in the closed section B105 and intends to move in the direction of an arrow T2*a*. Furthermore, the other train T3 is located in the closed section B109 and intends to move in the direction of an arrow T3*a*. (b) of FIG. 9 indicates a case where the other train T2 moves from the closed section B105 to the closed section B104 and goes out of the partial control region C12B. (a) of FIG. 10 indicates a case where the other train T3 moves from the closed section B109 to the closed section B108 and enters the partial control region C12B. (b) of FIG. 10 indicates a case where the control target train T1 moves from the closed section B125 to the closed section B129 and moves from the partial control region C12B to the partial control region C12C.

In the fourth embodiment, when another train enters from a region other than a partial control region where a control target train is present or when another train leaves from the partial control region where the control target train is present, the regeneration instruction unit 53 instructs the control logic generation unit 50 to regenerate a control logic. FIG. 8 is a flowchart showing another operation example (fourth embodiment) of the train control device 1 shown in FIG. 2. FIG. 9 and FIG. 10 are schematic diagrams for explaining the operation example (fourth embodiment) of the train control device 1 shown in FIG. 8.

Figure 8:
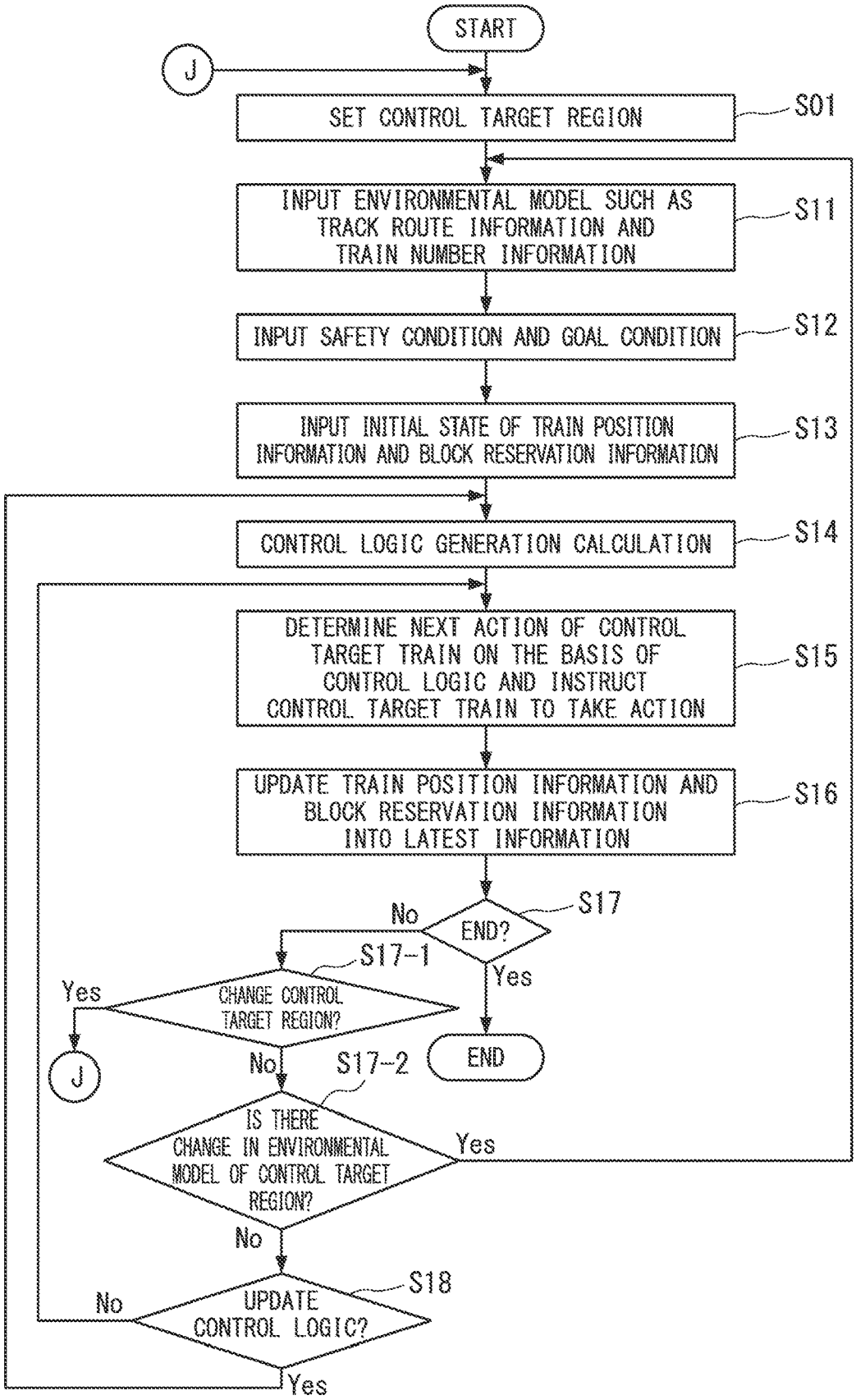
FIG. 8 is a flowchart showing another operation example (fourth embodiment) of the train control device 1 shown in FIG. 2.

In the process shown in FIG. 8, the process of step S01 at the beginning and the process of step S17-1 are added to the process shown in FIG. 6 (the third embodiment).

In step S01, for example, the environmental model generation unit 51 (or processing flow control unit (not illustrated)) divides the control target region C12 into a plurality of (for example, three) partial control regions and sets a partial control region (for example, the partial control region C12B), where the control target train T1 is located among the partial control regions, as a control target region. In such a case, the partial control region (for example, the partial control region C12B) set as the control target region in step S01 is used as a reference, and then, steps S11 to S16, that is, the process of inputting the environmental model such as the track route information and the train number information (step S11), the process of inputting the Safety condition and the goal condition (step S12), the process of inputting the initial state of the train position information and the block reservation information (step S13), the process of performing the control logic generation calculation (step S14), the process of determining the next action of the control target train on the basis of the control logic and instructing the control target train to take an action (step S15), and the process of updating the train position information and the block reservation information into the latest information (step S16) are performed.

Furthermore, the regeneration instruction unit 53 determines whether to end the process shown in FIG. 8 (step S17). When it is determined to end the process ("Yes" in step S17), the regeneration instruction unit 53 ends the process shown in FIG. 8, and when it is determined not to end the process ("No" in step S17), the regeneration instruction unit 53 determines whether it is necessary to change the control target region in step S17-1. When it is necessary to change the control target region ("Yes" in step S17-1), the regeneration instruction unit 53 returns the process to step S01, and sets the control target region again by, for example, the environmental model generation unit 51 (or processing flow control unit (not illustrated)) (step S01).

For example, as shown in (b) of FIG. 10, in the case where the control target train T1 moves from the partial control region C12B that is a current control target region to another partial control region C12C, the regeneration instruction unit 53 determines that it is necessary to change the control target region ("Yes" in step S17-1), and causes, for example, the environmental model generation unit 51 (or processing flow control unit (not illustrated)) to set the partial control region C12C again as the control target region (step S01).

On the other hand, when it is not necessary to change the control target region ("No" in step S17-1), the regeneration instruction unit 53 determines in step S17-2 whether there is a change in the environmental model of the control target region (for example, the partial control region C12B). When there is a change in the environmental model ("Yes" in step S17-2), the regeneration instruction unit 53 returns the process to step S11, and when there is no change in the environmental model ("No" in step S17-2), the regeneration instruction unit 53 determines whether to update the control logic in step S18.

For example, as shown in (b) of FIG. 9, in the case where the other train T2 moves from the partial control region C12B that is a current control target region to another partial control region C12A, or as shown in (a) of FIG. 10, when the other train T3 moves from another partial control region C12C to the partial control region C12B that is a current control target region, since there is a change in the number of trains that is information for defining the environmental model, the regeneration instruction unit 53 determines there is a change in the environmental model ("Yes" in step S17-2), and returns the process to step S11.

In the first to third embodiments, when a control target region is wide (the number of closed sections is large), the amount of calculation may be large, the calculation time may be long, and a large amount of resources for calculation may be required. However, in the fourth embodiment, since one control target region is narrowed, the amount of calculation can be reduced, which contributes to cost reduction and weight reduction due to resource reduction.

In the fourth embodiment, when a control logic is not updated during operation only by dividing a control target region into a plurality of regions, a control logic needs to be generated on the assumption that trains other than a control target train enter and exit the control target region. In such a case, the number of states to be assumed may be large and it may take more time than the practical time to calculate control logic generation, or the capacity of a calculating machine such as insufficient memory may be exceeded, resulting in the problem of inability to calculate. In the fourth embodiment, the calculation time is shortened by updating a control logic during operation, and is kept within a practical calculation time.

Fifth Embodiment

Figure 11:
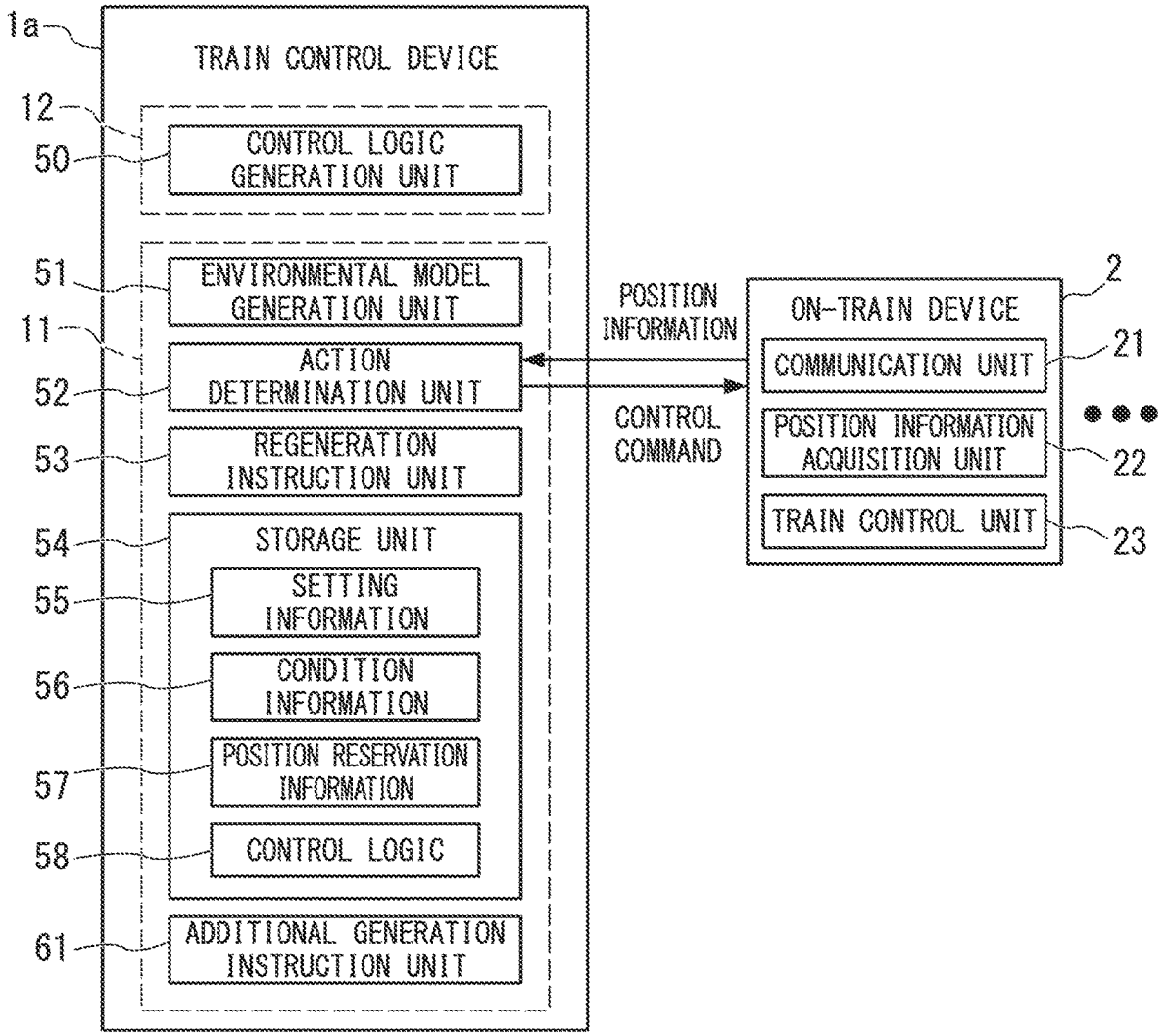
FIG. 11 is a block diagram showing another configuration example (fifth embodiment) of the train control device 1 and the on-train device 2 shown in FIG. 1.
Figure 12:
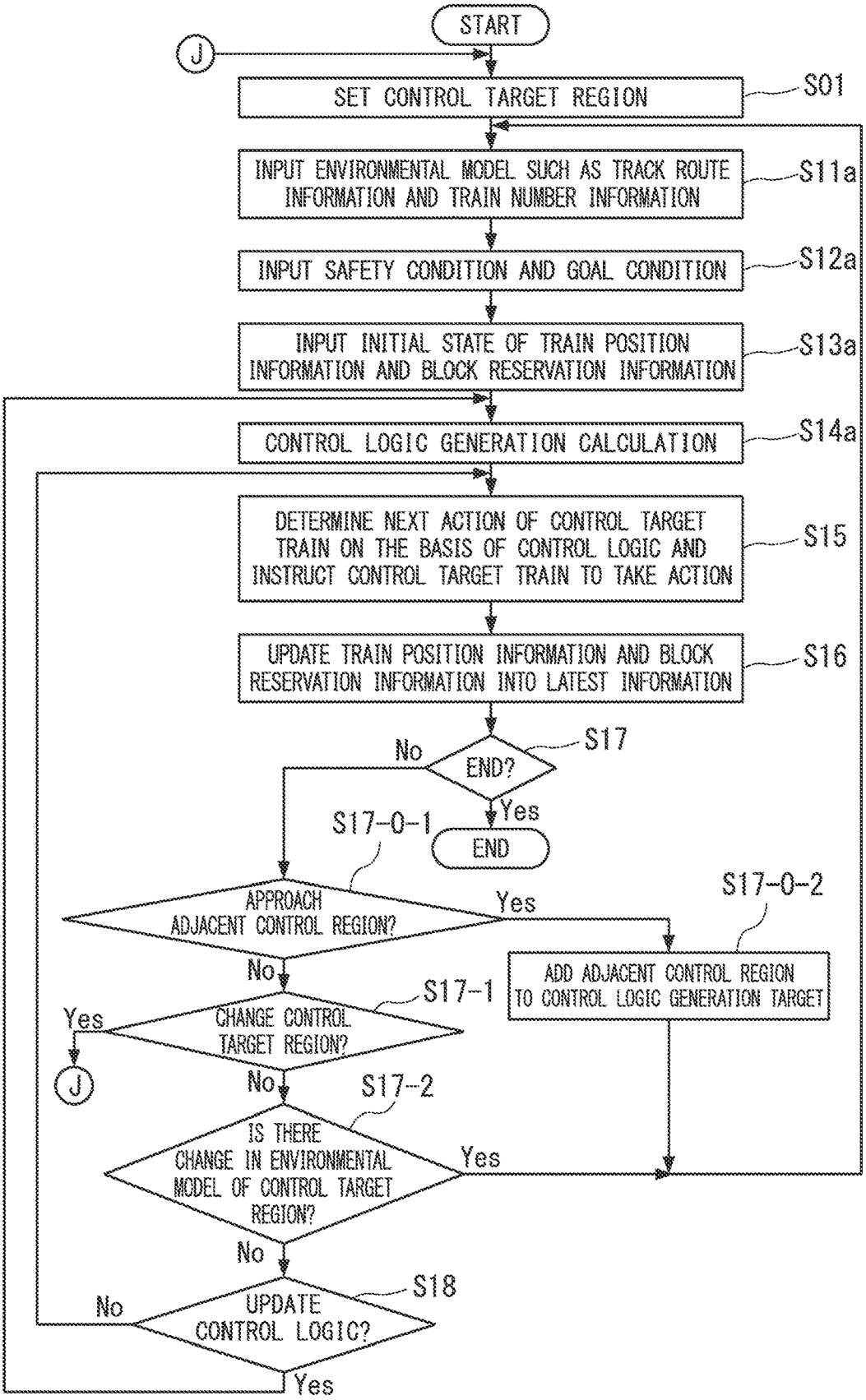
FIG. 12 is a flowchart showing an operation example (fifth embodiment) of a train control device 1*a* shown in FIG. 11.

Next, the fifth embodiment is described with reference to FIG. 11 and FIG. 12. FIG. 11 is a block diagram showing another configuration example (fifth embodiment) of the train control device 1 (train control device 1*a* in FIG. 11) and the on-train device 2 shown in FIG. 1. FIG. 12 is a flowchart showing the operation example (fifth embodiment) of the train control device 1*a* shown in FIG. 11.

In the fifth embodiment, as shown in FIG. 11, the train control device 1*a* (corresponding to the train control device 1 shown in FIG. 2) newly includes an additional generation instruction unit 61, as compared to the first to third embodiments. Furthermore, in the operation example of the fifth embodiment shown in FIG. 12, the process of step S17-0-1 and the process of step S17-0-2 are added to the process (fourth embodiment) shown in FIG. 8. Furthermore, in the operation example of the fifth embodiment shown in FIG. 12, the processing content of steps S11 to S14 (fourth embodiment) shown in FIG. 8 are partially changed (indicated as steps S11*a* to S14*a* in FIG. 12).

In the fifth embodiment, for example, as shown in (a) of FIG. 9, when the control target train T1 approaches the partial control region C12C different from the partial control region C12B that is a control target region where the control target train T1 is present, the additional generation instruction unit 61 instructs the control logic generation unit 50 to generate a control logic for another partial control region C12C in addition to the generation of a control logic for the partial control region C12B where the control target train T1 is present. The case of approaching another partial control region is, for example, when a control target train enters a closed section near the boundary between a control target region and another region. At this time, the additional generation instruction unit 61 instructs the control logic generation unit 50 to generate a control logic for another control region beyond the boundary. As the definition for near the boundary, a case where the control target train that moves until it reaches a closed section in contact with the boundary has entered a closed section where the number of closed sections is 0 to 2 is an exemplary example.

In the process shown in FIG. 12, the regeneration instruction unit 53 determines in step S17 whether to end the process shown in FIG. 12. When it is determined to end the process ("Yes" in step S17), the regeneration instruction unit 53 ends the process shown in FIG. 12.

When the regeneration instruction unit 53 determines not to end the process ("No" in step S17), the additional generation instruction unit 61 determines whether the control target train is approaching an adjacent (partial) control region (step S17-0-1). When the control target train is approaching the adjacent (partial) control region ("Yes" in step S17-0-1), the additional generation instruction unit 61 adds the adjacent control region to a control logic generation target (step S17-0-2), and returns the process to step S11*a*. When the adjacent control region is added to the control logic generation target, the partial control region added to the control logic generation target in step S17-0-2 is used as a reference, and then, steps S11*a* to S13*a*, that is, the process of inputting the environmental model such as the track route information and the train number information (step S11*a*), the process of inputting the Safety condition and the goal condition (step S12*a*), and the process of inputting the initial state of the train position information and the block reservation information (step S13*a*) are performed. Furthermore, in step S14*a*, the generation calculation of a control logic based on the control target region and the generation calculation of a control logic based on the adjacent control region are performed.

On the other hand, when the additional generation instruction unit 61 determines that the control target train is not approaching the adjacent (partial) control region ("No" step S17-0-1), the regeneration instruction unit 53 determines whether it is necessary to change the adjacent control target region (step S17-1).

In the fourth embodiment, since a control logic is updated after there is a change in an environmental model, when a control target train has entered an adjacent control region, there may be a waiting time until the generation of a new control logic is completed. On the other hand, in the fifth embodiment, a control logic is generated in advance by predicting a change in an environmental model when a control target train has entered an adjacent control region, so that a period in which a control is not performed can be eliminated.

Sixth Embodiment

Figure 13:
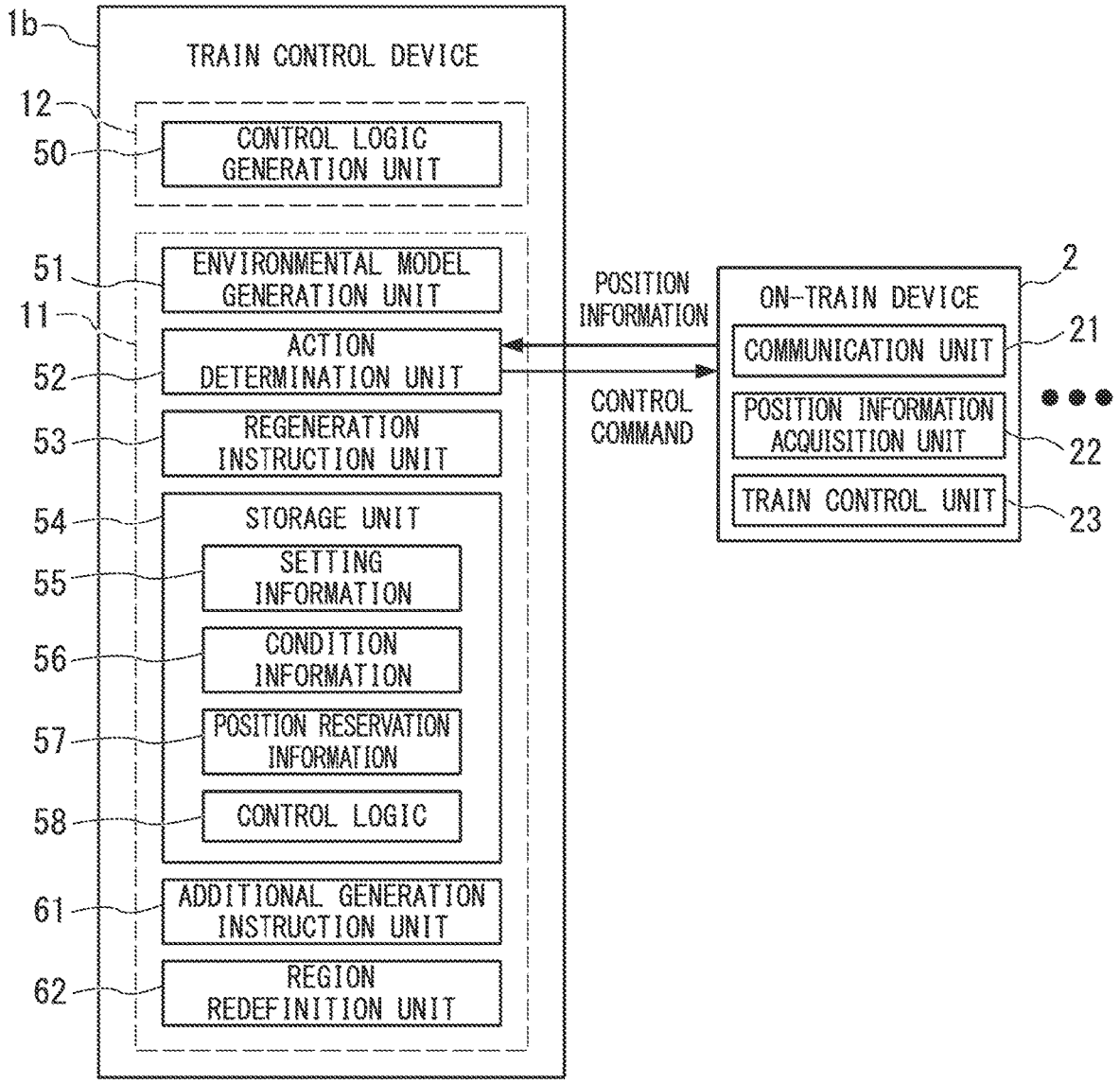
FIG. 13 is a block diagram showing another configuration example (sixth embodiment) of the train control device 1 and the on-train device 2 shown in FIG. 1.
Figure 14:
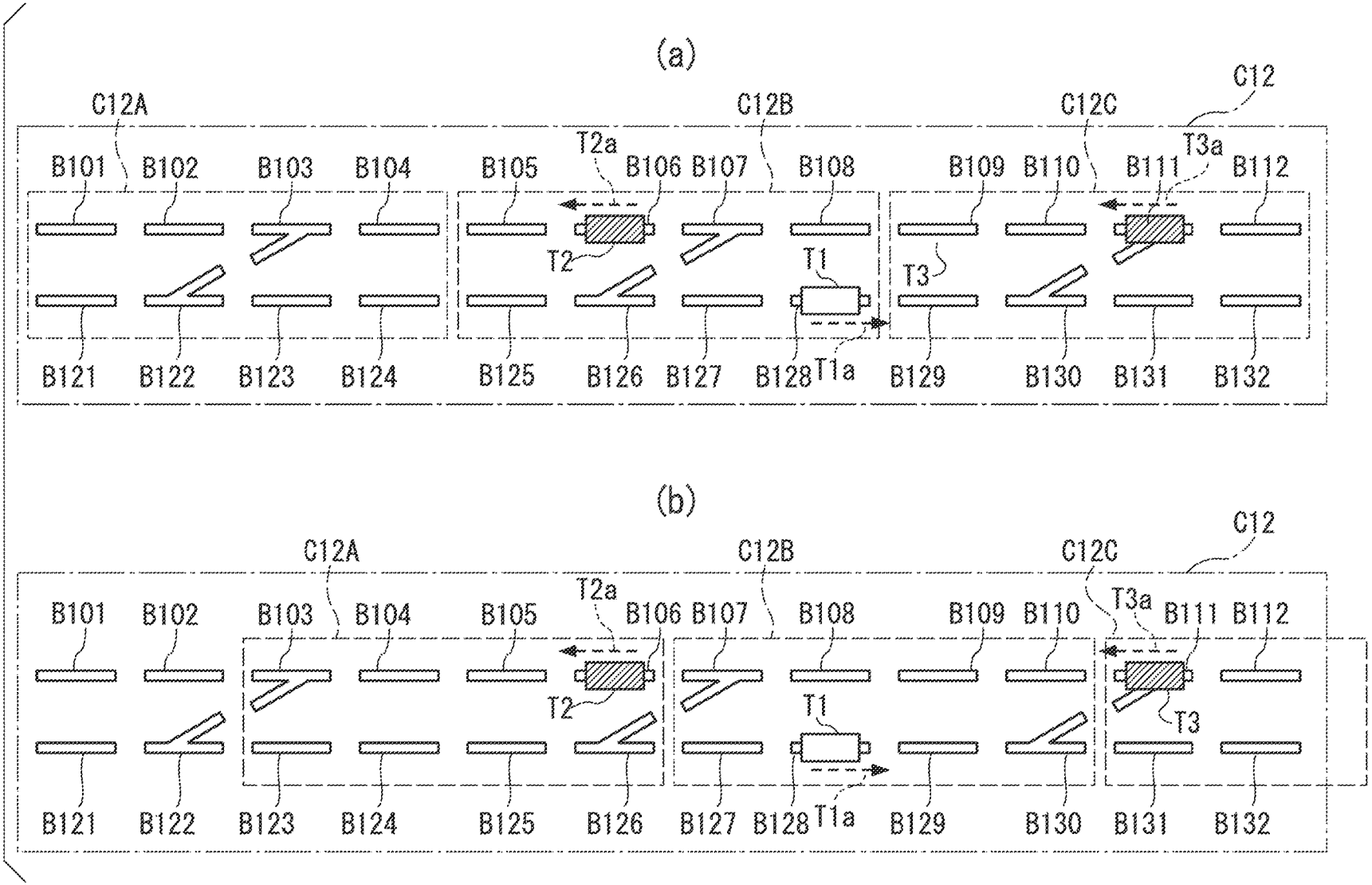
FIG. 14 is a schematic diagram for explaining an operation example (sixth embodiment) of a train control device 1*b* shown in FIG. 13.

Next, the sixth embodiment is described with reference to FIG. 13 and FIG. 14. FIG. 13 is a block diagram showing another configuration example (sixth embodiment) of the train control device 1 (train control device 1*b* in FIG. 13) and the on-train device 2 shown in FIG. 1. FIG. 14 is a schematic diagram for explaining the operation example (sixth embodiment) of the train control device 1*b* shown in FIG. 13.

In the sixth embodiment, as shown in FIG. 13, the train control device 1*b* (corresponding to the train control device 1*a* shown in FIG. 11) newly includes a region redefinition unit 62, as compared to the fifth embodiment. The region redefinition unit 62 redefines partial control regions according to the position of a control target train, for example, as shown in FIG. 14.

(a) of FIG. 14 shows an example before the redefinition of partial control regions. In the example shown in (a) of FIG. 14, the partial control region C12A includes the closed sections B101 to B104 and the closed sections B121 to B124. The partial control region C12B includes the closed sections B105 to B108 and the closed sections B125 to B128. The partial control region C12C includes the closed sections B109 to B112 and the closed sections B129 to B132. Furthermore, the control target train T1 is located in the closed section B128 and intends to move in the direction of an arrow T1*a*. Furthermore, the other train T2 is located in the closed section B106 and intends to move in the direction of an arrow T2*a*. Furthermore, the other train T3 is located in the closed section B111 and intends to move in the direction of an arrow T3*a*.

On the other hand, (b) of FIG. 14 shows an example after the redefinition of the partial control regions. In the example shown in (b) of FIG. 14, the partial control region C12A includes the closed sections B103 to B106 and the closed sections B123 to B126. The partial control region C12B includes the closed sections B107 to B110 and the closed sections B127 to B130. The partial control region C12C includes the closed sections B111 and B112 and the closed sections B131 and B132. Similarly to (a) of FIG. 14, the control target train T1 is located in the closed section B128 and intends to move in the direction of the arrow T1*a*. Furthermore, the other train T2 is located in the closed section B106 and intends to move in the direction of the arrow T2*a*. Furthermore, the other train T3 is located in the closed section B111 and intends to move in the direction of the arrow T3*a*.

In the fourth embodiment and the fifth embodiment, since a control logic is suddenly generated near the boundary, calculation is repeated many times in the case of control that crosses the boundary. In this regard, in the sixth embodiment, in order for a control target train to be prevented from reaching near the boundary of a control target region, a control target region is redefined so that the control target train is located near the center of the control target region when the control target train is approaching the boundary. Alternatively, the control target region may be redefined so that a constant number of closed sections present in the control region in the traveling direction is always secured. According to such a configuration, in the sixth embodiment, more stable control is possible.

The control region definition of the partial control region C12A and the partial control region C12C is not essential for the control of a control target train, but for example, when the fourth embodiment and the fifth embodiment are used together according to occasions, the definition and redefinition of the partial control region C12A and the partial control region C12C are essential.

Seventh Embodiment

In the first to sixth embodiments, the calculating machine 12 (the control logic generation unit 50) for control logic generation and some functional components and the like (for example, the action determination unit 52, the regeneration instruction unit 53, the additional generation instruction unit 61, the region redefinition unit 62, and the like) of the central control device 11 may be mounted on the control target train T1.

In the first to sixth embodiments, since the calculating machine 12 subordinate to the central control device 11 generates control logics for all trains, the calculation time may be long. Furthermore, since communication related to the collection of the state information and the control instruction is concentrated on the central control device 11, the burden is concentrated on the central control device 11. In the seventh embodiment, calculation and communication load are distributed to each train, and the central control device 11 can construct a lightweight system at low cost. Furthermore, autonomous control is possible for each train, so that train control can be continued without stopping control for all lines when the central control device 11 is broken down.

Although the embodiments of the invention have been described with reference to the drawings, detailed configurations are not limited to the above embodiments and design modifications and the like are included within a range not departing from the spirit of the present invention. For example, the configurations and operations in the first to sixth embodiments can be appropriately combined or omitted. For example, the additional generation instruction unit 61 shown in FIG. 13 can be omitted.

Computer Configuration

Figure 15:
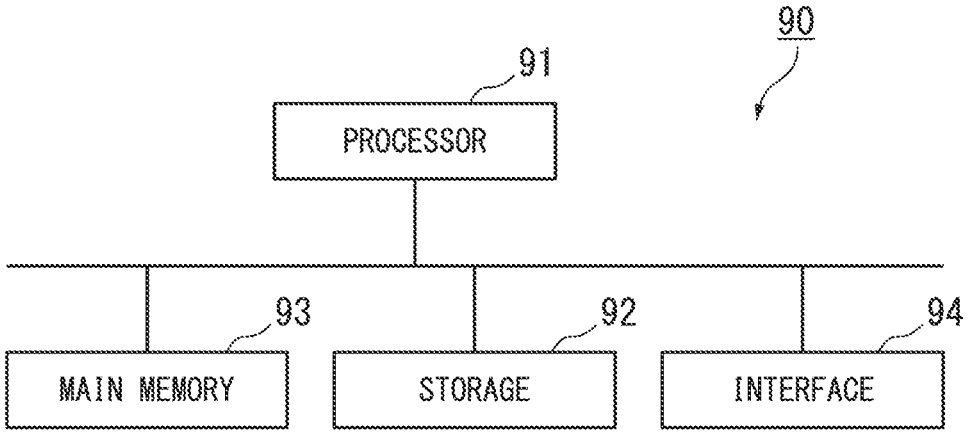
FIG. 15 is a schematic block diagram showing the configuration of a computer according to at least one embodiment.

FIG. 15 is a schematic block diagram showing the configuration of a computer according to at least one embodiment.

A computer 90 includes a processor 91, a main memory 92, a storage 93, and an interface 94.

The aforementioned train control device 1, central control device 11, and calculating machine 12 are mounted on the computer 90. The operation of each of the aforementioned processing units is stored in the storage 93 in the form of a program. The processor 91 reads the program from the storage 93, loads the program on the main memory 92, and performs the above process according to the program. Furthermore, the processor 91 secures a storage region corresponding to each of the aforementioned storage units in the main memory 92 according to the program.

The program may be for implementing some of functions to be exhibited by the computer 90. For example, the program may cause the functions to be exhibited in combination with other programs already stored in the storage, or in combination with other programs mounted on another device. In other embodiments, the computer may include a custom large scale integrated circuit (LSI) such as a programmable logic device (PLD) in addition to or in place of the above configuration. Examples of the PLD include a programmable array logic (PAL), a generic array logic (GAL), a complex programmable logic device (CPLD), and a field programmable gate array (FPGA). In such a case, some or all of the functions implemented by the processor may be implemented by an integrated circuit.

Examples of the storage 93 include a hard disk drive (HDD), a solid state drive (SSD), a magnetic disk, a magneto-optical disk, a compact-disc read only memory (CD-ROM), a digital versatile disc read only memory (DVD-ROM), and a semiconductor memory. The storage 93 may be an internal medium directly connected to a bus of the computer 90, or an external medium connected to the computer 90 via the interface 94 or a communication line. Furthermore, when the program is distributed to the computer 90 by the communication line, the computer 90 receiving the distribution may load the program on the main memory 92 and perform the above process. In at least one embodiment, the storage 93 is a non-transitory tangible storage medium.

INDUSTRIAL APPLICABILITY

According to each aspect of the present invention, since a control logic can be updated during train operation, the control logic can be generated without increasing the calculation cost as compared to a case where a control logic is not updated with an efficient control logic.

REFERENCE SIGNS LIST

1 Train control device
2 On-train device
3 Track system
4 Track
11 Central control device
12 Calculating machine
50 Control logic generation unit
51 Environmental model generation unit
52 Action determination unit
53 Regeneration instruction unit
61 Additional generation instruction unit
62 Region redefinition unit
T1, T2, T3 Train
B1 to B5, B101 to B112, B121 to B132 Closed section
C11, C12 Control target region
C12A, C12B, C12C, Partial control region

The invention claimed is:

1. A train control device, which controls trains by using an environmental model that is defined by the number of a plurality of closed sections constituting a track included in a predetermined control target region, a connection configuration of the closed sections, and the number of trains present on the track, a state of the environmental model being changed discretely according to a combination of a position of one control target train that is the train to be controlled, positions of zero or more other trains, and presence or absence of reservation for each of the closed sections, the train control device comprising:

a control logic generation unit configured to generate a control logic that is a logic for selecting any one of actions of "reservation of a closed section or release of the reservation", "movement to a reserved closed section", and "standby in a current closed section", which are to be performed by the control target train depending on the state of the environmental model, and transitioning the state of the environmental model depending on the selection result, so as to satisfy a predetermined condition that is a condition for passing through the control target region;

an action determination unit configured to sequentially determine the actions, which are to be performed by the control target train depending on the state of the environmental model, on the basis of the generated control logic until the predetermined condition is satisfied; and a regeneration instruction unit configured to instruct the control logic generation unit to regenerate the control logic with a present state of the environmental model as an initial state before the predetermined condition is satisfied.

2. The train control device according to claim 1, wherein the predetermined condition includes a condition to be reached as a target state and a condition that has to not be reached.

3. The train control device according to claim 1, wherein the control logic includes information indicating correspondence between a flow of a state transition of each of the closed sections included in the control target region and each of the actions to be sequentially performed by the control target train.

4. The train control device according to claim 1, wherein the regeneration instruction unit is configured to instruct the control logic generation unit to regenerate the control logic at a time when the state of the environmental model changes a plurality of times.

5. The train control device according to claim 1, wherein, when the environmental model has changed, the regeneration instruction unit is configured to instruct the control logic generation unit to regenerate the control logic by using the changed environmental model.

6. The train control device according to claim 1, wherein the control logic generation unit is configured to separately generate the control logics for a plurality of partial control regions into which the control target region is divided, and wherein the regeneration instruction unit is configured to instruct the control logic generation unit to regenerate the control logic when the other train enters from a region other than the partial control region where the control target train is present or when the other train leaves from the partial control region where the control target train is present.

7. The train control device according to claim 6, further comprising:

an additional generation instruction unit configured to, when the control target train approaches the other partial control region different from the partial control region where the control target train is present, instruct the control logic generation unit to generate a control logic for the other partial control region in addition to generation of the control logic for the partial control region where the control target train is present.

8. The train control device according to claim 6, further comprising:

a region redefinition unit configured to redefine the partial control region according to the position of the control target train.

9. The train control device according to claim 1, wherein the train control device is mounted on the train.

10. A method, which controls trains by using an environmental model that is defined by the number of a plurality of closed sections constituting a track included in a predetermined control target region, a connection configuration of the closed sections, and the number of trains present on the track, a state of the environmental model being changed discretely according to a combination of a position of one control target train that is the train to be controlled, positions of zero or more other trains, and presence or absence of reservation for each of the closed sections, the method comprising:

a step of selecting any one of actions of "reservation of a closed section or release of the reservation", "movement to a reserved closed section", and "standby in a current closed section", which are to be performed by the control target train depending on the state of the environmental model, so as to satisfy a predetermined condition that is a condition for passing through the control target region;

a step of generating a control logic that is a logic for transitioning the state of the environmental model depending on the selection result;

a step of sequentially determining the actions, which are to be performed by the control target train depending on the state of the environmental model, on the basis of the generated control logic until the predetermined condition is satisfied; and a step of regenerating the control logic with a present state of the environmental model as an initial state before the predetermined condition is satisfied.

11. A non-transitory computer readable medium which stores a program causing a computer, which constitutes a device for controlling trains to perform a method of controlling the trains by using an environmental model that is defined by the number of a plurality of closed sections constituting a track included in a predetermined control target region, a connection configuration of the closed sections, and the number of trains present on the track, a state of the environmental model being changed discretely according to a combination of a position of one control target train that is the train to be controlled, positions of zero or more other trains, and presence or absence of reservation for each of the closed sections, the method comprising:

a step of selecting any one of actions of "reservation of a closed section or release of the reservation", "movement to a reserved closed section", and "standby in a current closed section", which are to be performed by the control target train depending on the state of the environmental model, so as to satisfy a predetermined condition that is a condition for passing through the control target region;

a step of generating a control logic that is a logic for transitioning the state of the environmental model depending on the selection result;

a step of sequentially determining the actions, which are to be performed by the control target train depending on the state of the environmental model, on the basis of the generated control logic until the predetermined condition is satisfied; and a step of regenerating the control logic with a present state of the environmental model as an initial state before the predetermined condition is satisfied.

* * * * *